US009333541B2

(12) United States Patent
Yasunaga et al.

(10) Patent No.: US 9,333,541 B2
(45) Date of Patent: May 10, 2016

(54) POWDER REMOVAL DEVICE OF MEDICINE DISPENSER

(75) Inventors: Itsuo Yasunaga, Toyonaka (JP); Naoki Koike, Toyonaka (JP)

(73) Assignee: YUYAMA MFG. CO., LTD., Toyonaka-Shi, Osaka (JP)

( * ) Notice: Subject to any disclaimer, the term of this patent is extended or adjusted under 35 U.S.C. 154(b) by 648 days.

(21) Appl. No.: 13/581,515

(22) PCT Filed: Feb. 25, 2011

(86) PCT No.: PCT/JP2011/054249

§ 371 (c)(1),
(2), (4) Date: Aug. 28, 2012

(87) PCT Pub. No.: WO2011/108448

PCT Pub. Date: Sep. 9, 2011

(65) Prior Publication Data

US 2012/0324828 A1 Dec. 27, 2012

(30) Foreign Application Priority Data

Mar. 1, 2010 (JP) ..... 2010-044471
Jul. 2, 2010 (JP) ..... 2010-152004

(51) Int. Cl.
*B07B 1/12* (2006.01)
*B07B 1/28* (2006.01)
(Continued)

(52) U.S. Cl.
CPC ..... *B08B 7/02* (2013.01); *B65B 39/002* (2013.01); *B65B 55/00* (2013.01); *G07F 17/0092* (2013.01); *B65B 9/06* (2013.01)

(58) Field of Classification Search
CPC ..... B65B 5/103; B65B 53/02; B65B 39/002; B65B 1/04; B65B 39/02; B65B 1/08; B65B 35/14; B65B 35/34; B65B 37/04; B65B 1/28; B65B 55/24; B65B 9/06; B65B 9/073; B65B 9/08; B65B 9/093; A61J 7/0084; A61J 3/06; A61J 1/03; G07F 17/0092; B01F 15/0483; B01F 3/182; B01F 5/265; B07B 1/12; B07B 1/28; B07B 13/04; B07B 13/07; B65D 25/52
USPC ..... 209/233, 240, 245, 275, 552, 606, 632, 209/662, 674–679, 249, 252, 269, 51, 235; 53/513, 154, 167, 237, 240, 244, 247, 53/550, 562
See application file for complete search history.

(56) References Cited

U.S. PATENT DOCUMENTS 2,200,472 A * 5/1940 Erdmann ..... 209/27
2,425,984 A * 8/1947 Blackman ..... 134/7
(Continued)

FOREIGN PATENT DOCUMENTS

JP 2029257 A 1/1990
JP 11123699 A 5/1999
(Continued)

OTHER PUBLICATIONS

International Search Report for PCT/JP2011/054249, dated Apr. 5, 2011.

*Primary Examiner* — Andrew M Tecco
*Assistant Examiner* — Praachi M Pathak
(74) *Attorney, Agent, or Firm* — Hauptman Ham, LLP

(57) ABSTRACT

A dispenser feeds tablets from a storing section to a packaging section. A tablet-adhered powder removal device is provided in a preparation section between the storing section and the packaging section. The preparation section has rotating open-top receiving portions, and the tablets for one package are fed to each receiving section. One side wall of each receiving section includes a fixed plate having a groove-ridge portion, while the opposite side wall includes a swing plate. The swing plate vibrates when a cam roller rides on protrusions during the rotation of the receiving portion. Due to the vibration, the powder adhered to the tablets between the plates is stripped and removed. The powder falls from a gap formed by opening the plates, and is discharged to the outside. When the cam roller rides on a cam, the swing plate is swung and drops the tablets in the receiving portion.

19 Claims, 21 Drawing Sheets

(51) Int. Cl.

| | |
|---|---|
| ***B07B 13/04*** | (2006.01) |
| ***B07B 13/07*** | (2006.01) |
| ***A61J 1/03*** | (2006.01) |
| ***B08B 7/02*** | (2006.01) |
| ***G07F 17/00*** | (2006.01) |
| ***B65B 39/00*** | (2006.01) |
| ***B65B 55/00*** | (2006.01) |
| *B65B 9/06* | (2012.01) |

(56) References Cited

U.S. PATENT DOCUMENTS

| | | | | | |
|---|---|---|---|---|---|
| 2,617,137 | A | * | 11/1952 | Bodnar | 15/308 |
| 2,918,691 | A | * | 12/1959 | Lake | 15/308 |
| 3,096,532 | A | * | 7/1963 | Frank | 15/1.51 |
| 3,693,320 | A | * | 9/1972 | Garland | 53/167 |
| 3,774,368 | A | * | 11/1973 | Paprzycki et al. | 53/167 |
| 4,003,831 | A | * | 1/1977 | Tishkov et al. | 209/315 |
| 4,198,725 | A | * | 4/1980 | Trutzschler | 15/309.2 |
| 4,379,509 | A | * | 4/1983 | Bohle | 209/598 |
| 4,933,074 | A | * | 6/1990 | Fuller et al. | 209/540 |
| 5,238,124 | A | * | 8/1993 | Cane et al. | 209/660 |
| 5,504,972 | A | * | 4/1996 | Tada et al. | 15/404 |
| 5,661,249 | A | * | 8/1997 | Rupp et al. | 73/865.8 |
| 5,860,531 | A | * | 1/1999 | Satoru et al. | 209/37 |
| 5,971,038 | A | * | 10/1999 | Fiedler et al. | 141/83 |
| 6,050,064 | A | * | 4/2000 | Yuyama et al. | 53/514 |
| 6,488,192 | B1 | | 12/2002 | Yuyama et al. | |
| 7,059,479 | B2 | * | 6/2006 | Krahl | 209/540 |
| 8,138,321 | B2 | | 3/2012 | Bower et al. | |
| 2003/0034373 | A1 | | 2/2003 | Yuyama et al. | |
| 2003/0038143 | A1 | | 2/2003 | Hashimoto et al. | |
| 2010/0287880 | A1 | | 11/2010 | Yasunaga et al. | |
| 2011/0031167 | A1 | * | 2/2011 | Augst | 209/44.1 |
| 2011/0170655 | A1 | | 7/2011 | Yuyama et al. | |
| 2011/0309101 | A1 | * | 12/2011 | Kokie et al. | 221/30 |

FOREIGN PATENT DOCUMENTS

| | | | |
|---|---|---|---|
| JP | 11206854 | A | 8/1999 |
| JP | 11226089 | A | 8/1999 |
| JP | 2000203501 | A | 7/2000 |
| JP | 2003063503 | A | 3/2003 |
| JP | 2005059903 | A | 3/2005 |
| JP | 2006306430 | A | 11/2006 |
| JP | 2007135982 | A | 6/2007 |
| JP | 2007284087 | A | 11/2007 |
| JP | 2008162609 | A | 7/2008 |
| JP | 2008200234 | A | 9/2008 |
| JP | 2009100911 | A | 5/2009 |
| JP | 2010504097 | A | 2/2010 |
| JP | 4527810 | B2 | 8/2010 |
| WO | 2009054440 | A1 | 4/2009 |

* cited by examiner (a)

(b)

(a)

(b)

(a)

(b)

(a)

(b)

POWDER REMOVAL DEVICE OF MEDICINE DISPENSER

CROSS-REFERENCE TO RELATED APPLICATIONS

This application is a 35 U.S.C §371 national stage filling of International Application No. PCT/JP2011/054249 filed on Feb. 25, 2011, which claims priority to Japanese Patent Application No. 2010-044471 filed on Mar. 1, 2010 and Japanese Patent Application No. 2010-152004 filed on Jul. 2, 2010.

TECHNICAL FIELD

The present invention relates to a powder removal device of a medicine dispenser which dispenses tablets and prepares a medicine according to a prescription in hospitals, clinics, pharmacies, etc.

BACKGROUND

By way of example of such a medicine dispenser that prepares a tablet medicine according to a prescription, there is a medicine dispenser which feeds required tablets from a tablet storing section having a plurality of tablet feeders to a tablet packaging section according to a prescription and packages the tablets one package at a time (see FIGS. 1 to 3 in Patent Document 1). Further, there is another medicine dispenser wherein a tablet storing section comprises the tablet feeders arranged in a shape of a shelf step and, similarly to the aforesaid medicine dispenser, required tablets are fed from the tablet storing section to a tablet packaging section according to a prescription and then is packaged one package at a time (see FIG. 6 in Patent Document 2).

In the aforesaid medicine dispenser, a tablet preparation section is provided between the tablet storing section and the tablet packaging section. The tablet preparation section keeps together tablets for one package and then feeds the tablets for one package to the tablet packaging section in a lump (see Paragraph [0051], lines 1 to 2, Paragraphs [0088] and [0101] to [0105] and FIGS. 11 to 15 in Patent Document 1).

Further, by way of example of the aforesaid tablet feeder, there is a tablet feeder wherein: a container for containing a large number of tablets houses a rotating rotor; receiving grooves (recesses) for receiving the tablets are formed in the rotor along an entire periphery of the rotor at equal spacing; along with the rotation of the rotor, the receiving groove receives the tablets in the container and moves the same in the rotation direction; and if the receiving groove faces to a discharge outlet, then the tablets in the receiving groove fall from the receiving groove to the discharge outlet one tablet at a time and thus the tablets are dispensed (see Patent Document 3).

Further, according to some prescription, a tablet to be taken one time may be a half tablet (the half of a tablet). In this case, it is necessary that a tablet cut and divided into halves in advance be set to the dispensing device and then be dispensed. By way of example of such a tablet divider, there is a tablet divider wherein a pair of belt conveyors sandwich a tablet and transfer the tablet downwardly and a rotary cutter divides the tablet in two halves during the transfer of the tablet (see FIG. 1 in Patent Document 4). Further, there is another tablet divider wherein a tablet is transferred to a tube and the tablet is stopped by a shutter and then divided in two halves by a cutter during the transfer of the tablet. Further, in said another tablet divider, the tablet piece of a lower half falls, while the tablet piece of an upper half is held on the cutter and then falls along with the retraction of the cutter (see FIG. 6 in Patent Document 5).

In the aforesaid tablet feeders, when the tablet is dispensed, a portion of the tablet chips or fragment powder is made due to friction. In particular, the feeder dividing the tablet creates powder when dividing the tablet. This is problematic since some medicine takers dislike these powders contained in a package bag for tablets. For this reason, there is a technique wherein a brush rakes powder particles at a halfway point of a dispensing passage from the rotor of the tablet feeder and discharges them through the discharge outlet (see Claim 3, Paragraph [0024] and FIG. 2 in Patent Document 6). Further, there is another technique wherein powder particles adhering to tablets are removed by suction or air blast in a tablet manufacture process or a tablet inspection process (see Abstract of Patent Document 7 and Abstract of Patent Document 8).

Patent Document 1: Japanese Laid-Open Patent Application No. 2009-100911

Patent Document 2: Japanese Laid-Open Patent Application No. 2008-162609

Patent Document 3: Japanese Laid-Open Patent Application No. 2005-59903

Patent Document 4: Japanese Laid-Open Patent Application No. Hei 2-29257

Patent Document 5: Japanese Laid-Open Patent Application No. Hei 11-226089

Patent Document 6: Japanese Laid-Open Patent Application No. 2006-306430

Patent Document 7: Japanese Laid-Open Patent Application No. 2008-200234

Patent Document 8: Japanese Laid-Open Patent Application No. 2007-135982

Patent Document 9: Japanese Laid-Open Patent Application No. 2003-63503

SUMMARY

The process for powder particles described in the above-mentioned Patent Document 6 is irrelevant to stripping (removing) the adhesion powder particles from the tablet. As a result, the adhesion powder is fed from the tablet storing section to the tablet packaging section together with the tablet. That is, this does not prevent the adhesion powder particles from being contained in a package bag for tablets. Further, it may be considered that the suction means or the air blast means are equipped in a tablet passage of a medicine dispenser to remove the adhesion powder from the tablet. However, this requires a large-scale suction or air blast mechanism and does not facilitate the treatment of the removed powder particles.

Thus, in light of the foregoing circumstances, it is an object of the present invention to perform removal of the powder (powder particles) adhered to the tablet with simple structure.

To achieve the above object, given that the tablet preparation section temporarily keeps together tablets for one package from the tablet storing section, the present invention removes the tablet-adhered powder by means of vibration in the tablet preparation section. Since the tablet preparation section temporarily keeps together the tablets, the adhesion powder of the tablet can be removed when vibration is applied to the tablets while the tablets are kept together.

The present invention provides a powder removal device of a medicine dispenser, which feeds a tablet dispensed from a tablet storing section having a plurality of tablet feeders to a tablet packaging section and packages the tablet. The powder removal device is interposed between the tablet storing section and the tablet packaging section to remove a tablet-adhered powder. The powder removal device comprises: a top-opened receiving portion to which a tablet for one package is inputted from the tablet storing section, the top-opened receiving portion being provided between the tablet storing section and the tablet packaging section; means for vibrating the top-opened receiving portion; and means for opening and closing a bottom of the top-opened receiving portion. The bottom of the top-opened receiving portion has a gap, through which the tablet does not fall. The gap is opened by the opening and closing means to the extent of permitting the tablet to fall.

According to the above-described configuration, the tablet in the top-opened receiving portion is subjected to vibrate due to the vibration of the top-opened receiving portion. The tablet bounces due to such vibration and thus the adhered powder is stripped therefrom. The stripped powder falls downwardly through the gap of the bottom. A powder collecting tray located below the gap in the bottom of the top-opened receiving portion receives the falling powder. The powder collecting tray is detachable. In this case, it is preferred that an inner surface of the receiving portion has a slip property by coating the inner surface with a slippage agent such as fluorine resin or sticking a sheet or plate piece with such a slippage agent coated so that the tablet and the powder stripped therefrom cannot adhere.

As the configuration of the top-opened receiving portion, the following various shapes may be considered: a rectangular boxlike shape, a cylindrical boxlike shape, an inverted conical boxlike shape, a boxlike shape of an inverted polygonal pyramid such as a boxlike shape of an inverted triangular pyramid or a boxlike shape of an inverted quadrangular pyramid, a boxlike shape of an inverted conical frustum, a boxlike shape of an inverted polygonal frustum such as a boxlike shape of an inverted triangular frustum or a boxlike shape of an inverted quadrangular frustum, or the like. Although the receiving portion may have any one of the above-described shapes, it is preferred that the bottom of the receiving portion has the gap and the tablet powder is stripped by means of vibration and the gap is opened when the powder is discharged. For this reason, "the gap through which the tablet does not fall" is a gap for discharging the powder. The gap may not be formed in the bottom except when performing the dispensing operation (see an embodiment to be described below). Widening or narrowing the gap in the bottom can be achieved by moving a member constituting the bottom by means of the opening and closing means.

As the concrete configuration of the top-opened receiving portion, for example, the following configuration may be employed: a pair of opposing side wall plates constituting the top-opened receiving portion are disposed in a shape of an inverted triangle; both lower ends of the side wall plates have a gap through which the tablet does not fall; and at least one of the pair of the side wall plates is configured to be opened by the opening and closing means of the bottom of the top-opened receiving portion to the extent that the gap in the lower ends of both of the side wall plates permits the tablet to fall therethrough. In the above-described configuration, being opened and closed of both of the side wall plates of the top-opened receiving portions to the extent of permitting the tablet to fall are done by swingably supporting the side wall plate at the upper end thereof and swinging the side wall plate. The aforementioned swing is done by the opening and closing means. Further, for example, the swing may be done by appropriately using an actuator plunger, a motor, means for swinging the side wall plate by a slide movement between the side wall plate and a cam with a cam surface for vertically moving the side wall plate (see an embodiment to be described below), or the like.

As the vibrating means for the top-opened receiving portion, one of the following is appropriately employed: a vibration motor wherein an eccentric part is provided in a rotating shaft of a motor coupled to the top-opened receiving portion; and means for bringing the top-opened receiving portion into slide contact with a plurality of prominences and depressions in sequence to vibrate the top-opened receiving portion (see an embodiment to be described below).

Further, it is preferred that the tablet preparation section includes a plurality of the top-opened receiving portions in view of keeping together a large number of tablets for one package and smoothly feeding the tablets for one package to the tablet packaging section in sequence. As the configuration of the tablet preparation section, the following configuration may be employed: a plurality of the top-opened receiving portions are provided in a rotator at equal interval around a rotation center of the rotator; an introducing inlet to the tablet packaging section opens in a portion of a rotation trajectory of each of the top-opened receiving portions; and an introducing inlet from the tablet storing section faces along a rotation direction of the rotator from the introducing inlet (see an embodiment to be described below).

With regard to the above-described configuration, the following configuration may be employed: at least one of the pair of the opposing side wall plates of the top-opened receiving portion is swingably supported at an upper end thereof and is biased by a spring in a direction of contacting the other side wall plate; the swingable side wall plate is contacted with and separated from a prominence and depression around the rotator; and the swingable side wall plate is swung while maintaining the gap through which the tablet does not fall, thereby applying the vibration. In this case, the aspect that "the swingable side wall plate is swung while maintaining the gap through which the tablet does not fall" also includes that the lower ends of both of the side wall plates are in contact with each other during the vibration. Further, it is preferred that the rotator in its entirety does not rattle due to the vibration. For example, a fixed roller is provided for abutting the rotator to restrain the vibration.

More specifically, a cam roller may be provided in a swing shaft of the swingable side wall plate via an arm extending in a diametrical direction of the swing shaft and the cam roller may be contacted with and separated from the prominence and depression, thereby applying the vibration. By adjusting the biasing force of the spring, the lower ends of both of the side wall plates may maintain the gap through which the tablet does not fall during the vibration. However, it is very difficult to suitably adjust it. Thus, a stopper, which engages the swingable side wall plate such that the swingable side wall plate maintains the gap, is preferably provided in the rotator. When the gap in the lower ends of both of the side wall plates is opened by the opening and closing means of the bottom of the top-opened receiving portion to the extent of permitting the tablet to fall, the stopper needs to permit such an action. Thus, in such a case, the stopper is configured to release the engagement to the side wall plate. The release of the engagement may be done by a slide movement of a pawl on a cam to be described below.

Similar to the cam roller described in Patent Document 1 (see Paragraphs to [0061] and FIG. 13 in Patent Document 1), the above-described cam roller performs its operation by rolling on a cam surface of the cam provided around the rotator (see Reference numeral 82*d* in FIG. 13 in Patent Document 1) such that the bottom of the top-opened receiving portion is opened to the extent of permitting the tablet to fall.

The powder removal device can be provided in the tablet preparation section of various medicine dispensers. As for the medicine dispenser with the tablet dividing feeder cutting and dividing a tablet and dispensing the same, it is important to remove the cut powder made due to such division. Thus, it is preferred that the powder removal device is provided in the medicine dispenser with such a tablet dividing feeder. As the configuration of the tablet dividing feeder, the following configuration may be employed: a tablet is transferred in one direction such as a horizontal direction; a fixed blade is positioned on the way of the tablet; the tablet is divided by the fixed blade due to the transfer of the tablet; a lower tablet piece is discharged due to division caused by the fixed blade, while an upper tablet piece rides from the fixed blade onto a support piece adjoining the fixed blade and is held on the support piece; and the upper tablet piece is discharged from the support piece due to its further transfer (see Paragraphs to [0056] and FIGS. 6 to 8, 12 and 13 in Japanese Patent Application No. 2010-504097).

According to the present invention, as described above, the powder removal means is provided in the medicine preparation section. Thus, tablets, from which the adhesion powder such as a cut powder is removed to the utmost, are fed to the medicine packaging section, thereby, to the utmost, avoiding that such a powder is contained in a package bag for the tablets.

DETAILED DESCRIPTION

The following embodiment employs the present invention to the medicine dispenser described in the above-mentioned Patent Document 1. The tablet storing section in this embodiment includes at least one tablet dividing feeder. As described in the specification and drawings of the above-mentioned Japanese Patent Application No. 2010-504097, the tablet dividing feeder is configured as follows: a tablet T is transferred in one direction such as a horizontal direction; a fixed blade is positioned on the way of the tablet and divides the tablet due to the transfer of the tablet T; a lower tablet piece (lower half tablet) T1 is discharged due to division caused by the fixed blade, while an upper tablet piece (upper half tablet) T1 rides from the fixed blade on a support piece adjoining the fixed blade and is then held on the support piece; and the upper tablet piece T1 is discharged from the support piece due to its further transfer.

Figure 1:
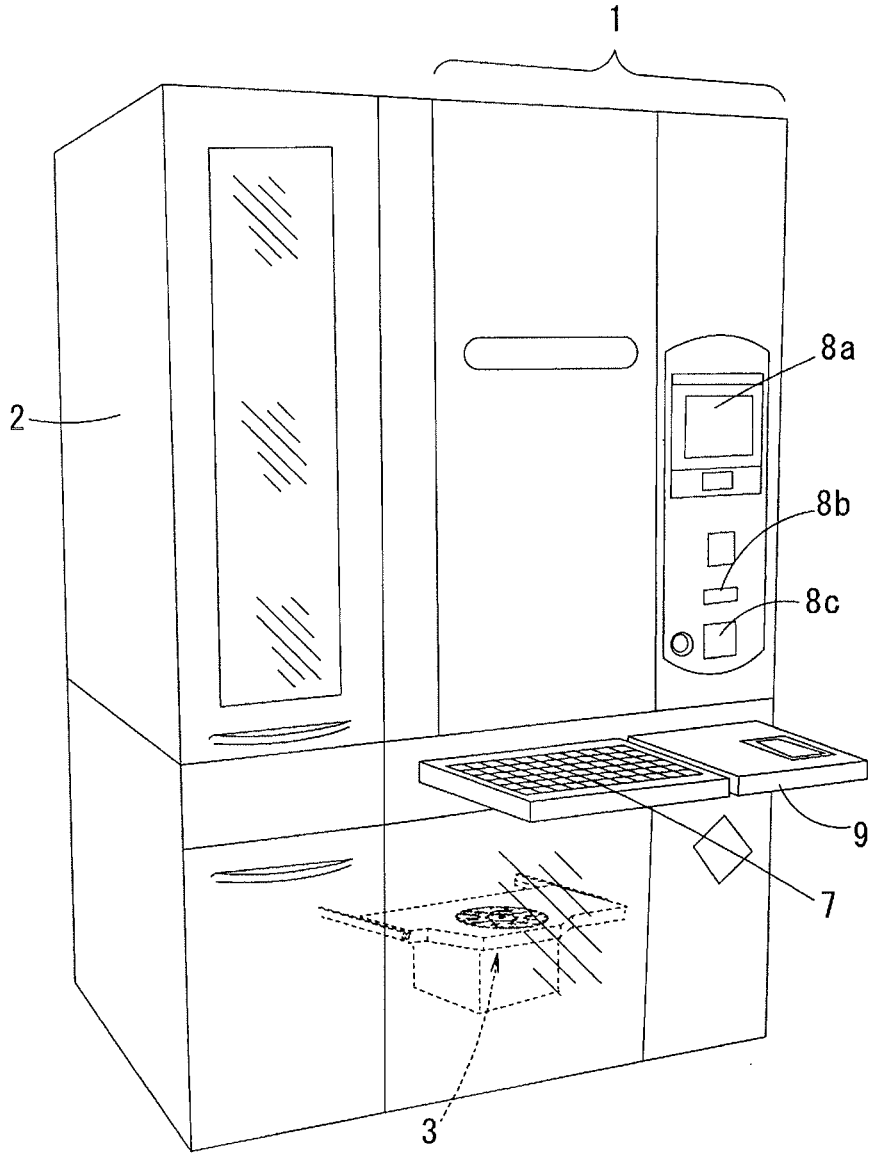
FIG. 1 is a schematic perspective view of a medicine dispenser according to the present invention.
Figure 2:
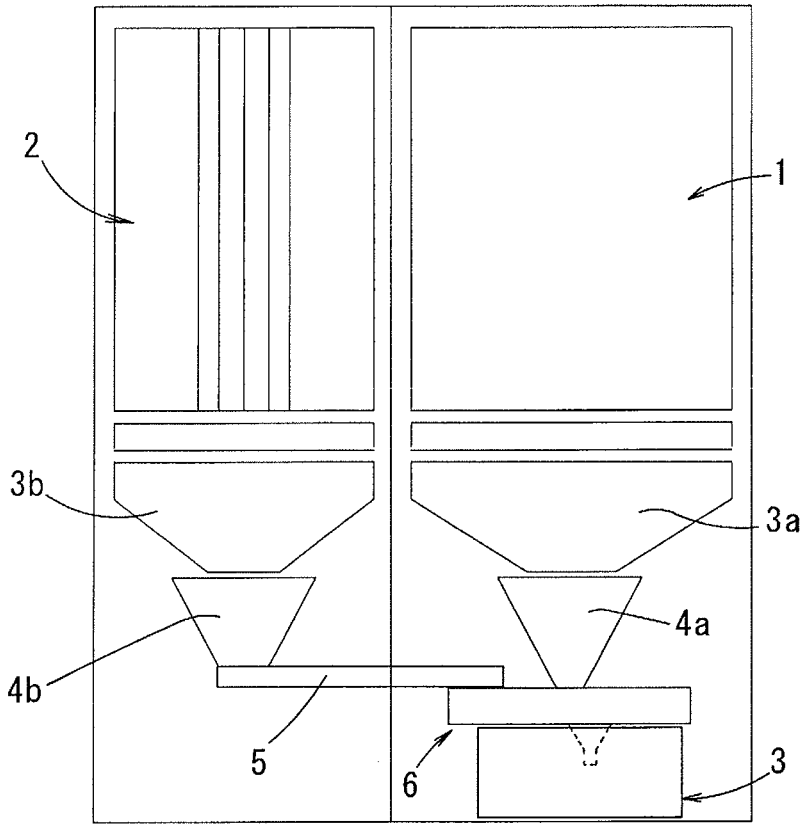
FIG. 2 is a schematic front view according to the embodiment wherein a front face is removed.

As shown in FIGS. 1 and 2, the medicine dispenser includes a main tablet storing section 1 and a sub tablet storing section 2. Both of the tablet storing sections 1, 2 are provided with tablet feeders (tablet dividing feeder) in a plurality of rows around the whole circumference of a device housing case (see FIG. 3 in the above-mentioned Patent Document 1 and FIG. 1 in the above-mentioned Patent Document 9). The tablets T (these include half tablets T1 and are referred to as including the half tablet hereinafter) are dispensed from both of the tablet storing sections 1, 2 by the respective tablet feeders according to prescriptions. Then, the tablets are conveyed to a medicine preparation section 6 through a medicine-standby mechanism 3*a*, 3*b*, a collection hopper 4*a*, 4*b* and a transfer device 5. A medicine packaging section 3 is provided next to the medicine preparation section 6. Further, a manual distribution unit 7, a liquid-crystal manipulation panel 8*a*, a barcode reader 8*b*, a journal printer 8*c* and a work table 9 are provided in a front face of the medicine dispenser. The configuration and function of them are the same as those described in the above-mentioned Patent Document 1.

Figure 3:
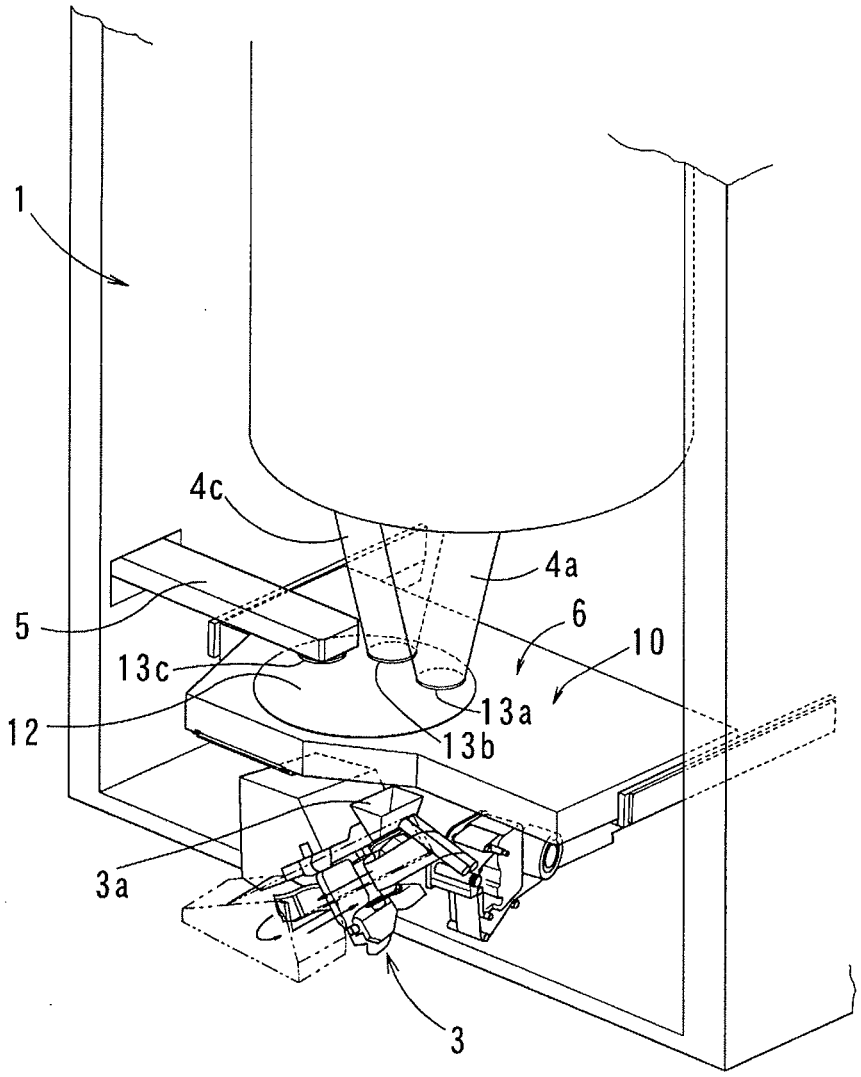
FIG. 3 is a perspective view showing a main part in the embodiment.
Figure 4:
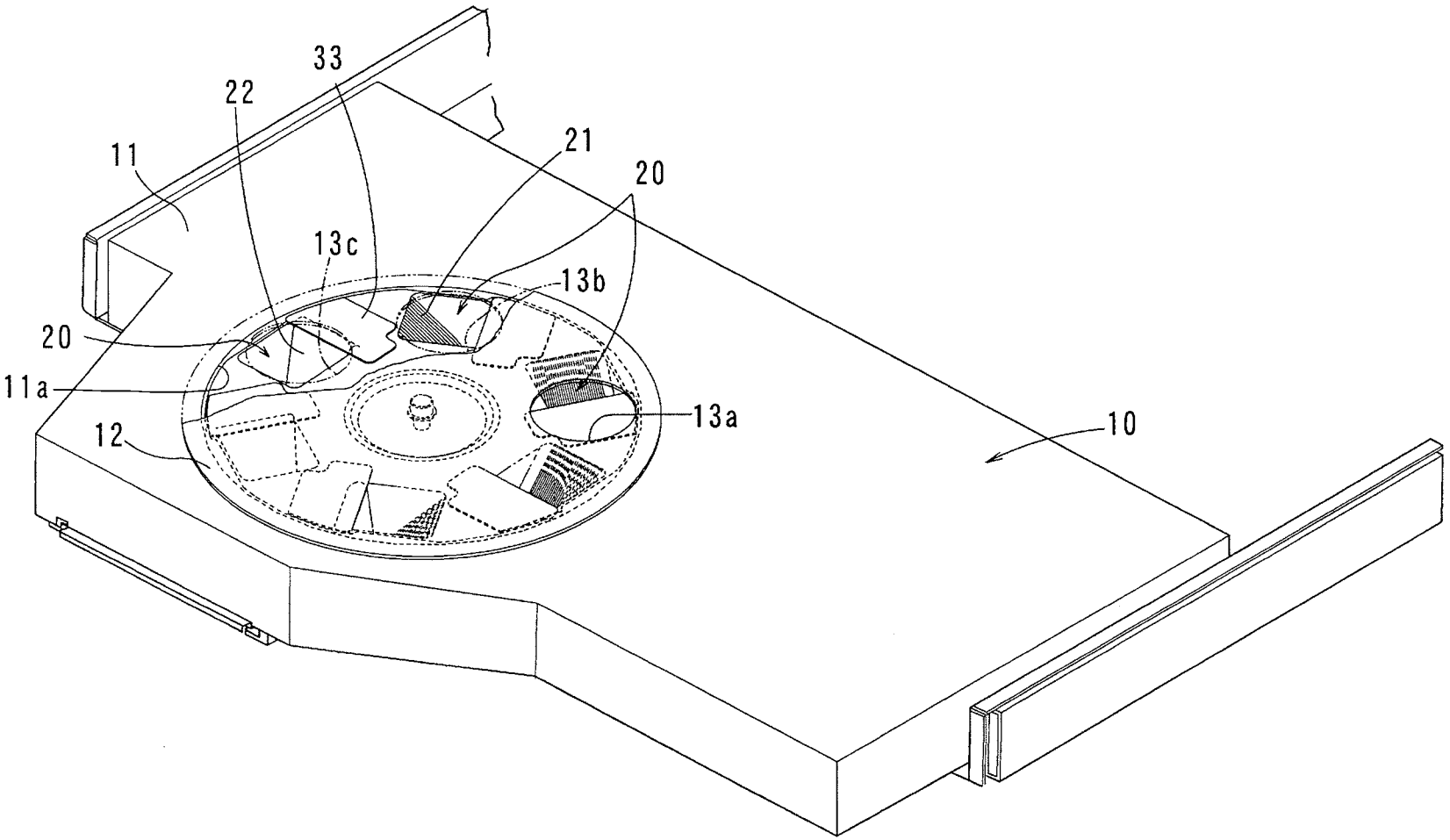
FIG. 4 is a perspective view showing a medicine preparation section in the embodiment.
Figure 5:
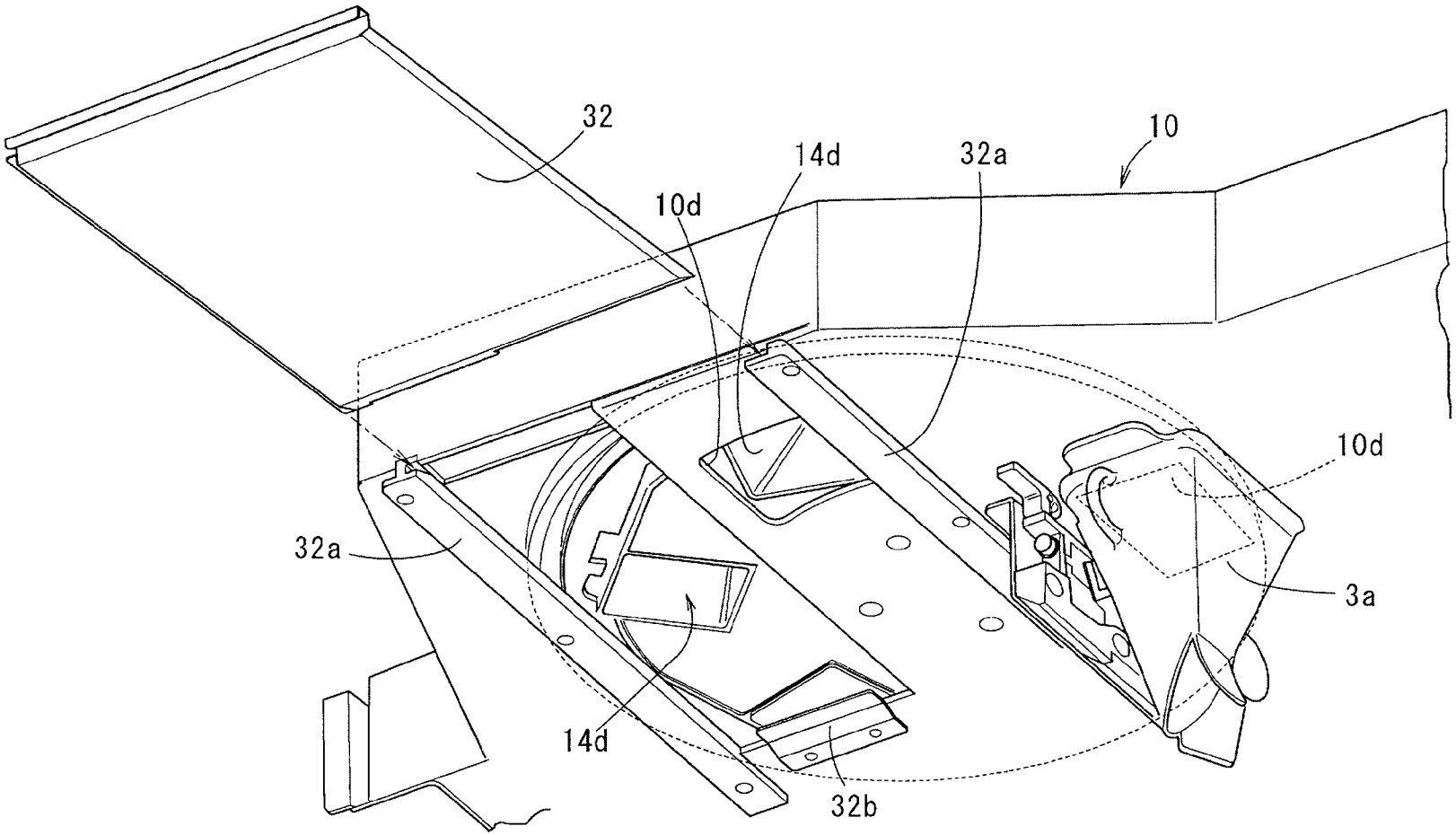
FIG. 5 is a lower perspective view of the medicine preparation section.

The features of the inventions according to this application reside in the medicine preparation section 6. As shown in FIGS. 3 to 5, a circular opening 11*a* is formed in a ceiling plate 11 of a housing 10 of the medicine preparation section 6. Tablet introducing inlets (feeding inlets) 13*a*, 13*b*, 13*c* (collectively, 13) are formed in a cover 12 for closing the circular opening 11*a*. The collection hopper 4*a* of the main tablet storing section 1, the transfer device 5 of the sub tablet storing section 2 and the collection hopper 4*c* of the manual distribution unit 7 are connected to the introducing inlets 13*a*, 13*b*, 13*c*, respectively. The tablets T from both of the tablet storing sections 1, 2 and the manual distribution unit 7 are sequentially fed from each of the introducing inlets 13*a*, 13*b*, 13*c* into the medicine preparation section 6 (see FIG. 3).

Figure 6:
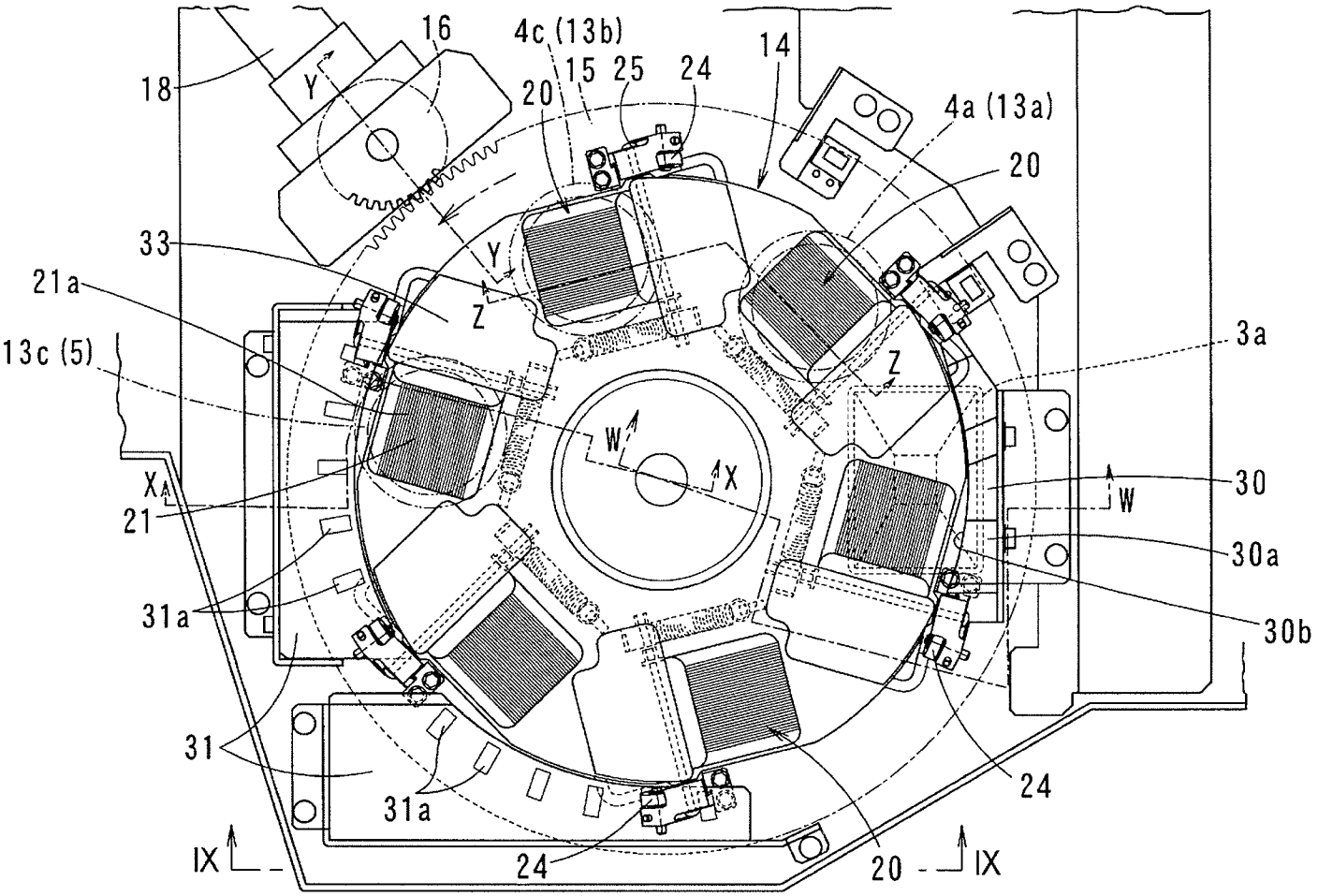
FIG. 6 is a top view showing a main part of the medicine preparation section.
Figure 7:
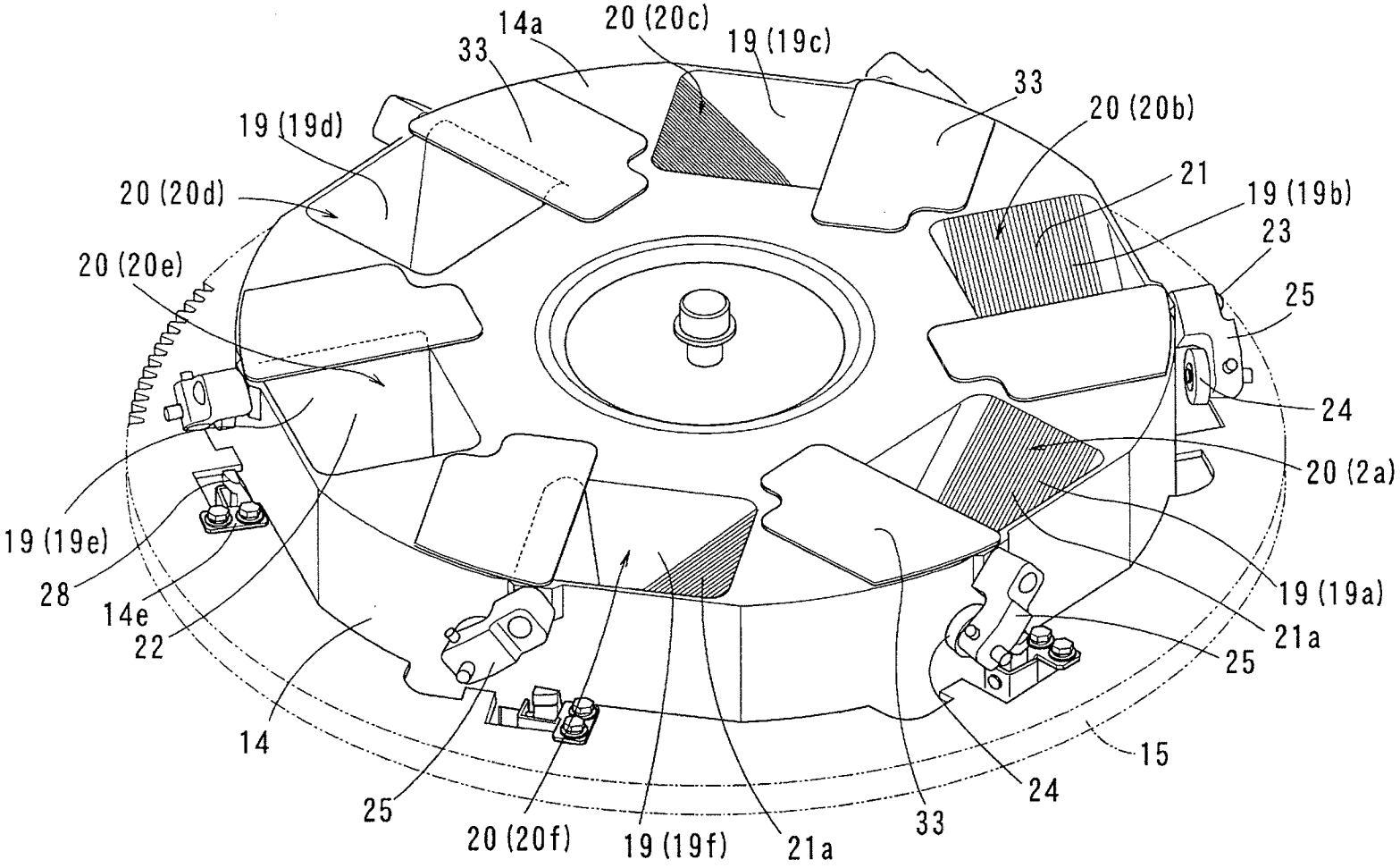
FIG. 7 is a perspective view showing a main part of the medicine preparation section.
Figure 9:
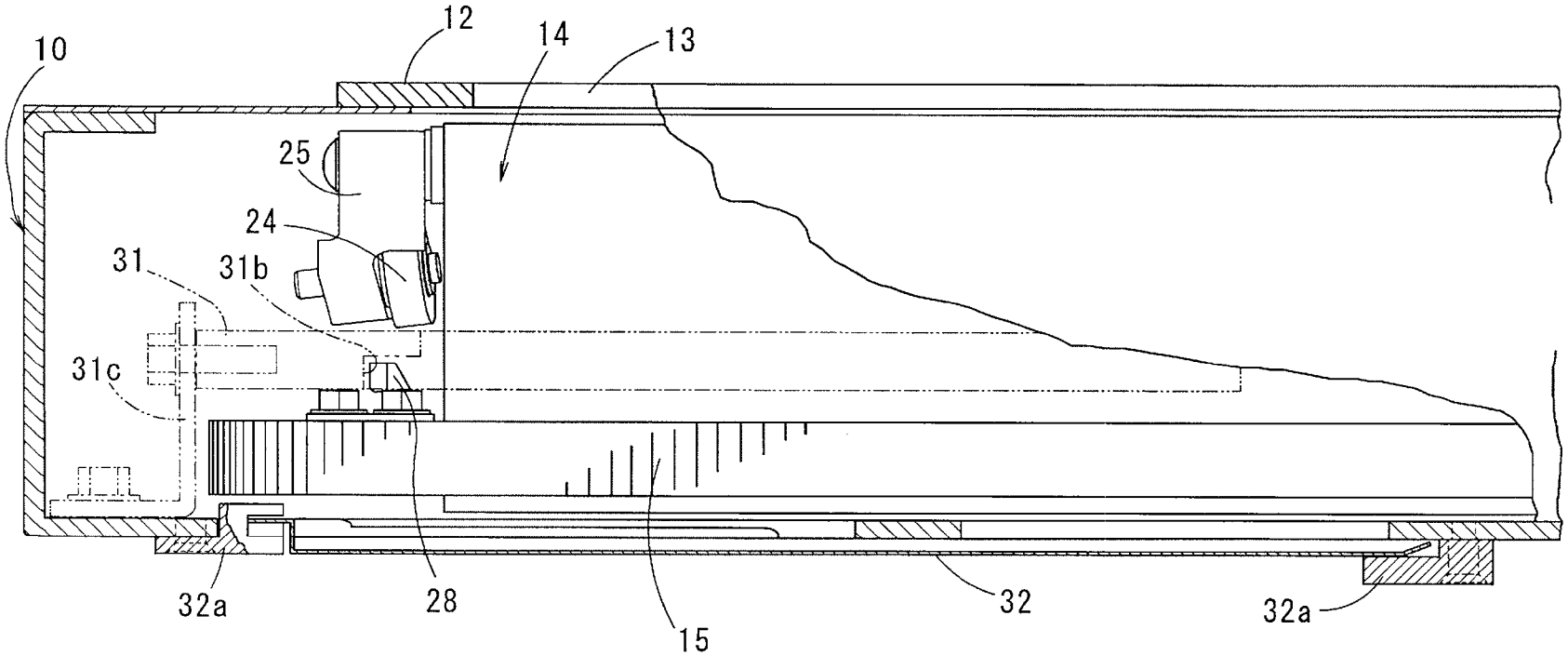
FIG. 9 is a sectional view taken along the line IX-IX in FIG. 6.
Figure 10:
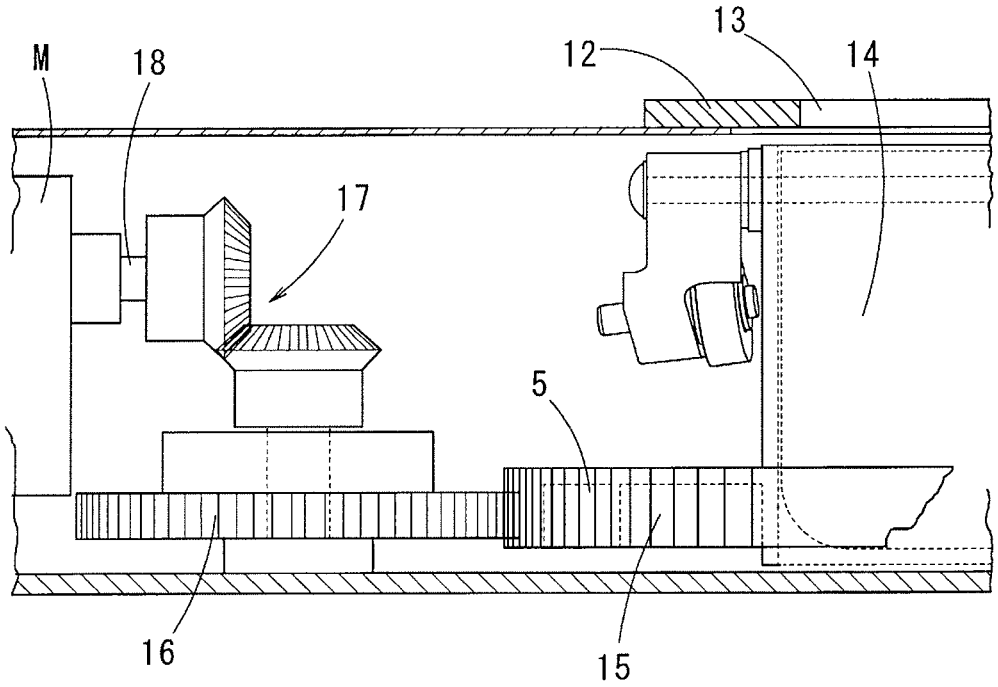
FIG. 10 is a sectional view taken along the line Y-Y in FIG. 6.

A lidded cylindrical rotator 14 is provided in the housing 10 of the medicine preparation section 6. A large gear 15 is provided along a periphery of the rotator 14 (see FIGS. 9 and 10). A small gear 16 is in mesh with the large gear 15. A rotating shaft 18 of a motor M is coupled to the small gear 16 via bevel gears 17 (see FIG. 10). The rotator 14 is intermittently rotated by the motor M at a necessary angle (in this embodiment, at an interval of 60 degrees) in a counterclockwise direction as shown by an arrow in FIG. 6. Open holes 19*a*-19*f* (collectively, 19) are formed in a lid portion 14*a* of the rotator 14 at the necessary angular interval (see FIG. 7). Top-opened receiving portions 20*a*-20*f* for receiving tablets amounting to one package are formed in the open holes 19*a*-19*f* respectively. All the top-opened receiving portions 20*a*-20*f* have the same configuration. Thus, hereinafter, they are referred to as the top-opened receiving portion 20 and its configuration will be described. The number of the top-opened receiving portion 20 is optional.

Figure 11:
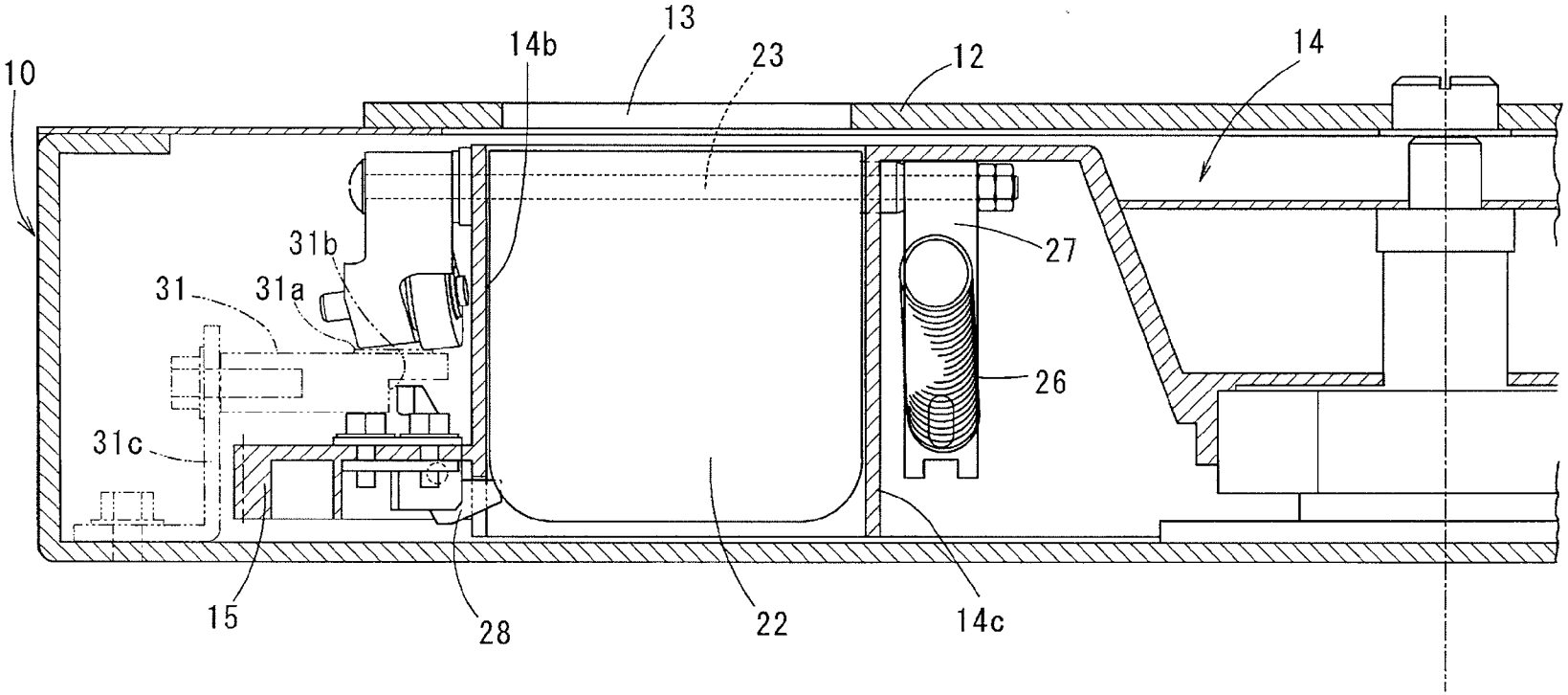
FIG. 11 is a sectional view taken along the line X-X in FIG. 6.

An outer side wall of the top-opened receiving portion 20 in a diametric direction of the rotator 14 comprises an outer peripheral wall 14*b* of the rotator 14, while an inner side wall thereof comprises a cylindrical inner wheel 14*c* (see FIG. 11). Further, side walls of the top-opened receiving portion, which are opposed in a circumferential direction of the rotator 14, comprises a fixed plate 21, which has a groove-ridge portion 21*a* in a vertical direction, and a flat plate-shaped swing plate (propeller plate) 22. Both of the plates 21, 22 are disposed at normal times in the shape of an inverted triangle wherein lower ends of them are in contact with each other (see FIGS. 15A(*a*) and 16(*a*)). The swing plate 22 is swingable through a rotating shaft (swing shaft) 23 in an upper end thereof. The groove-ridge portion 21*a* may be formed in the swing plate 22. Further, only the swing plate 22 may comprise a plate with the groove-ridge portion 21*a* or both of the plates 21, 22 may comprises a plate without the groove-ridge portion 21*a*. The groove-ridge portion 21*a*, by means of a groove-ridge shape thereof, prevents the tablets T as well as an adhesion powder a, which is stripped due to vibration (this will be described below), from not falling as adhering to each plate 21, 22 due to static electricity. The groove-ridge portion may comprise a plurality of verrucous protrusions.

A bottom of the rotator 14 below each top-opened receiving portion 20 includes an open hole (tablet discharging outlet) 14*d* (see FIG. 5). Thus, similar to the top-opened receiving portion 20, six tablet discharging outlets 14*d* are defined at an interval of 60 degrees. Further, an open hole (dispensing outlet) 10*d*, through which the tablet powder a and the tablet T pass (fall), is formed in a bottom plate of the housing 10 where the tablet discharging outlet 14*d* faces to the hopper 3*a* of the tablet packaging section 3 as well as a portion for removing the tablet powder a (a portion forming protrusions 30*a*) (this will be described below). Further, a cam 30 and a plurality of protrusions 31*a* are provided on top of the bottom plate of the housing 10 along the outer periphery of the rotator 14. The plurality of the protrusion 31*a* form a prominence and depression, on which a cam roller 24 (this will be described below) rolls to thereby move vertically.

Figure 8:
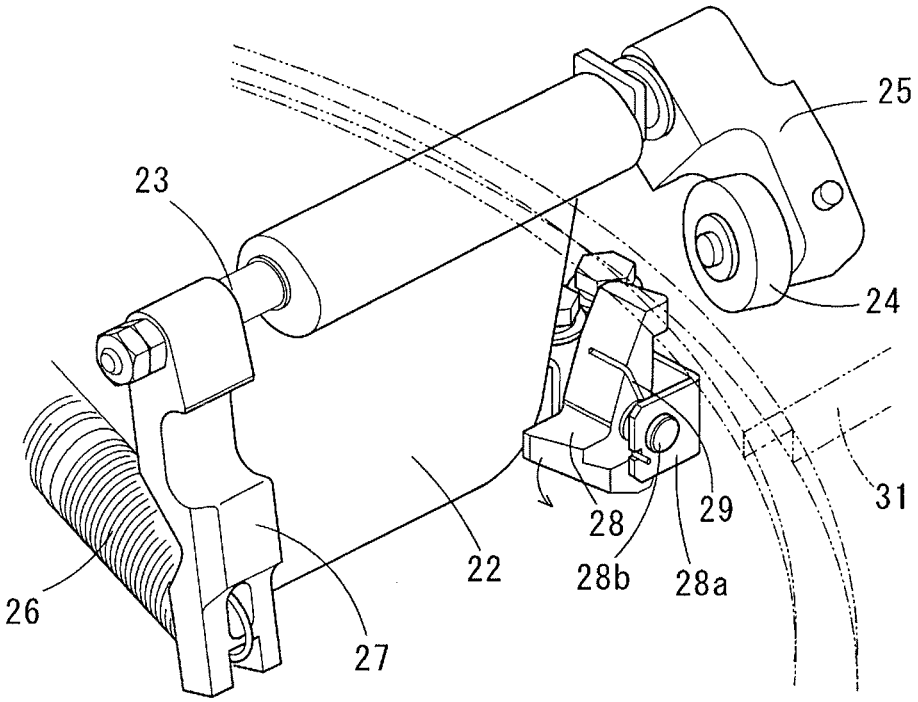
FIG. 8 is a perspective view showing a main part of a top-opened receiving portion of the medicine preparation section.
Figure 14:
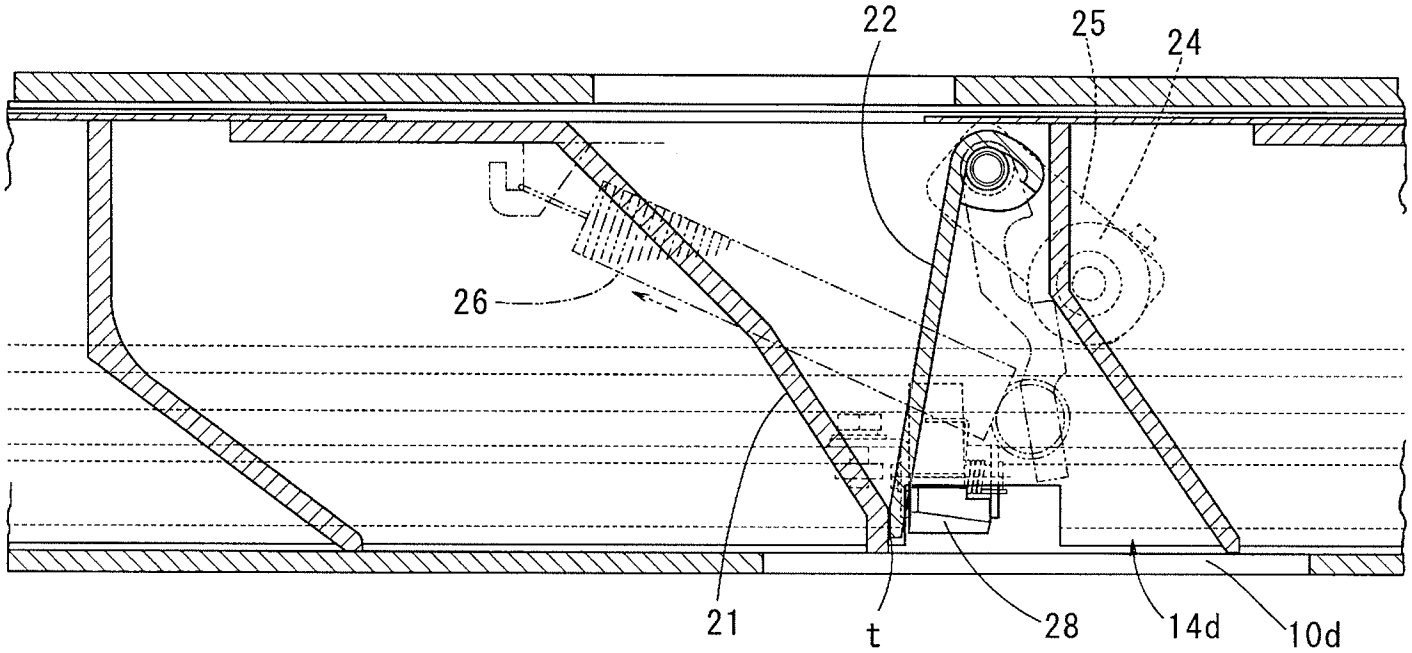
FIG. 14 is a sectional view taken along the line Z-Z in FIG. 6.

As shown in FIG. 8, the cam roller 24 is coupled to an outward end of the rotating shaft 23 of the swing plate 22 (in the diametrically outward direction of the rotator 14) via a support arm 25. The swing plate 22 swings in concomitance with the vertical movement of the cam roller 24 (swings around the rotating shaft 23). Further, a spring 26 is provided in an inward end of the rotating shaft 23 of the swing plate 22 via a support arm 27. The spring biases the swing plate 22 at normal times such that the lower end of the swing plate is in contact with the lower end of the fixed plate 21 (see FIG. 14). In this case, the lower ends of both of the plates 21, 22 may have a gap t, which does not permit the tablet T to fall therethrough even if the lower ends of both of the plates do not contact each other, therebetween.

Further, a pawl 28, which abuts a back surface of the swing plate 22 to thus regulate the swing of the swing plate, is provided in a support portion 14*e* that is in the large gear 15 beside the rotator 14. The pawl is pivotable through a shaft 28*b* of a support metal part 28*a* (see FIGS. 7, 8, 11 and 12). The pawl 28 is biased by a spring 29 at normal times such that a lower end of the pawl is in engagement with the back surface of the swing plate 22. The pivotal movement caused by such bias is restricted when an upper portion of the pawl 28 abuts a U-shaped inner wall of the support metal part 28*a* (as shown by a solid line in FIG. 8). Further, as shown from a chain line to a solid line in FIG. 13, if the upper end of the pawl slides to a lateral surface 30*b* of the cam 30 (lateral cam surface) (this will be described below), then such slide pushes the upper end of the pawl 28 toward the swing plate 22 against the spring 29, thereby releasing the engagement between the lower end of the pawl and the back surface of the swing plate 22. When the engagement is released, the swing plate 22 can swing (pivot) further upwardly.

Figure 13:
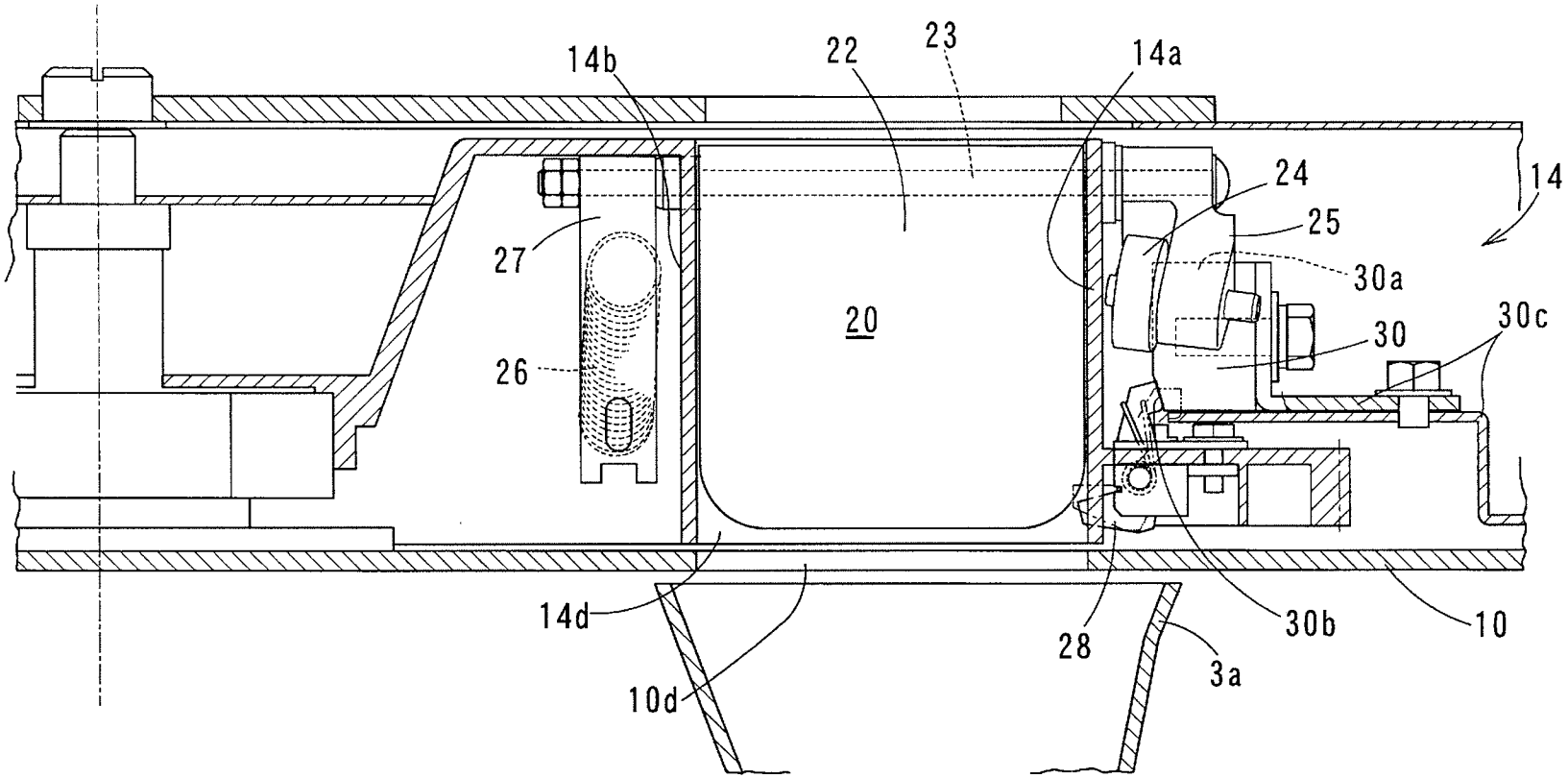
FIG. 13 is a sectional view taken along the line W-W in FIG. 6.
Figure 15A:
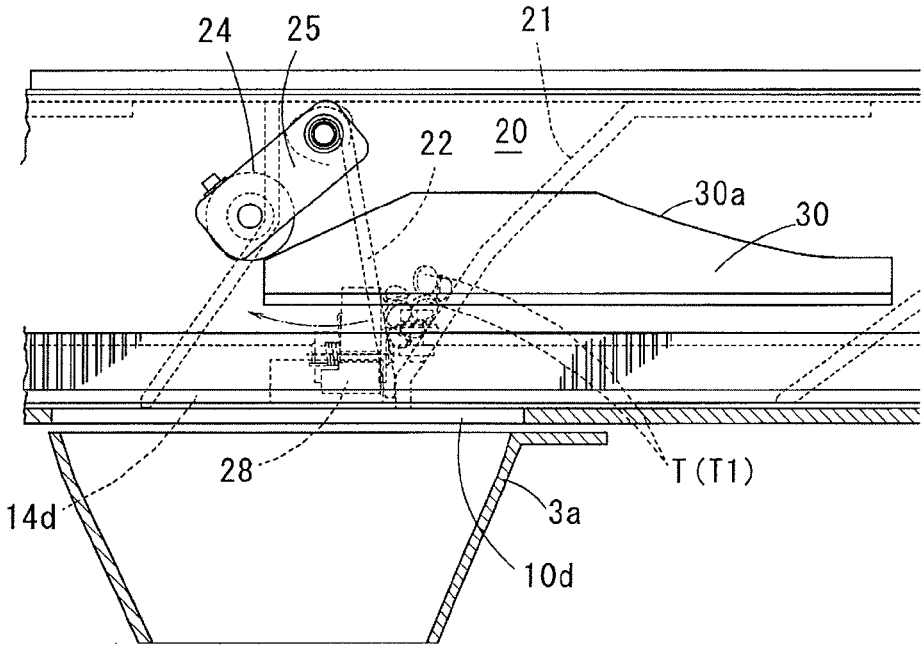
FIG. 15A illustrates a tablet dispensing operation in the embodiment, wherein (a) is a cutaway front view and (b) is a cutaway side view.
Figure 15A:
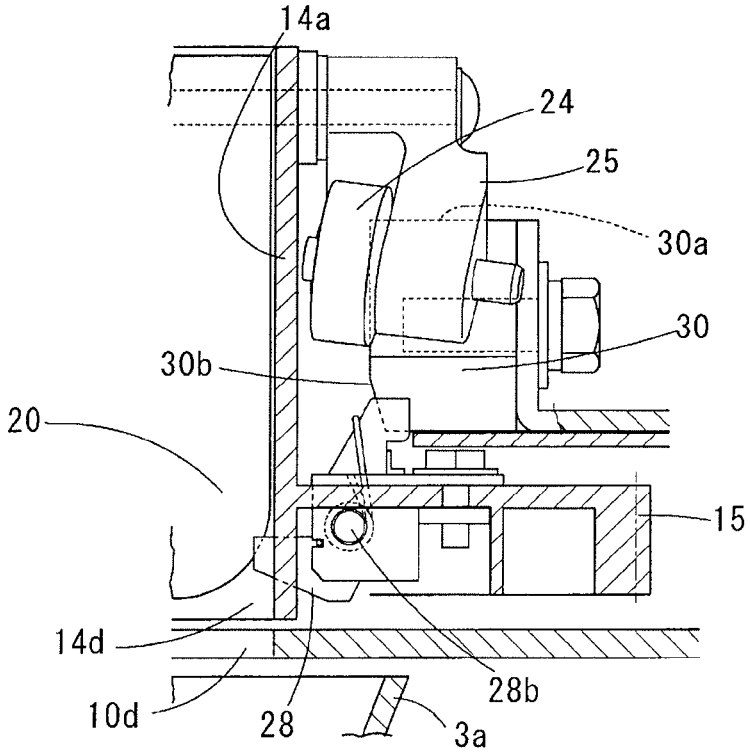
Figure 15B:
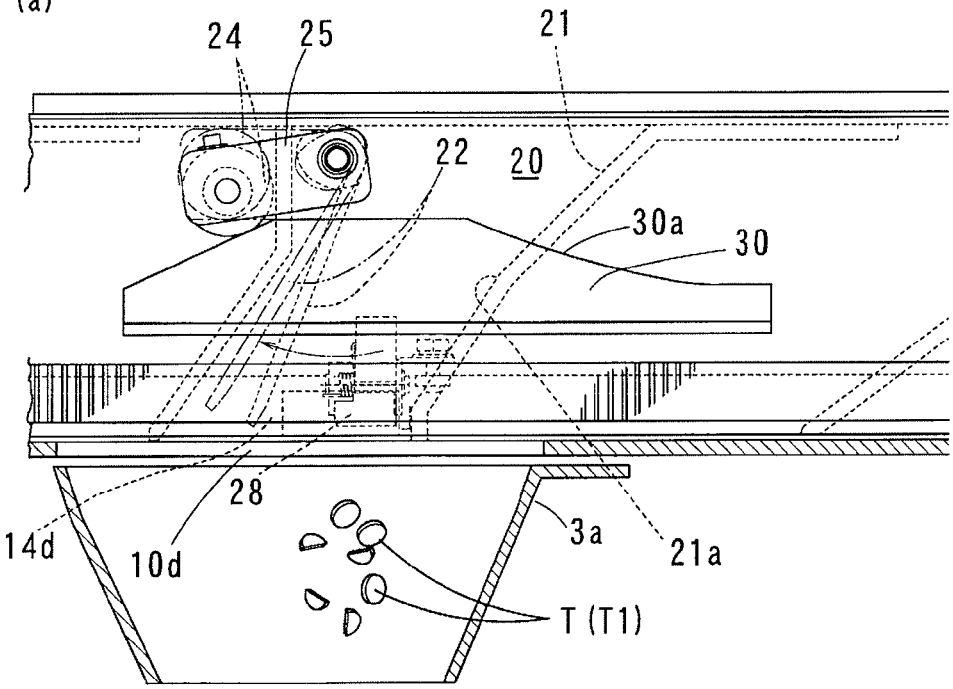
FIG. 15B illustrates the tablet dispensing operation, wherein (a) is a cutaway front view and (b) is a cutaway side view.
Figure 15B:
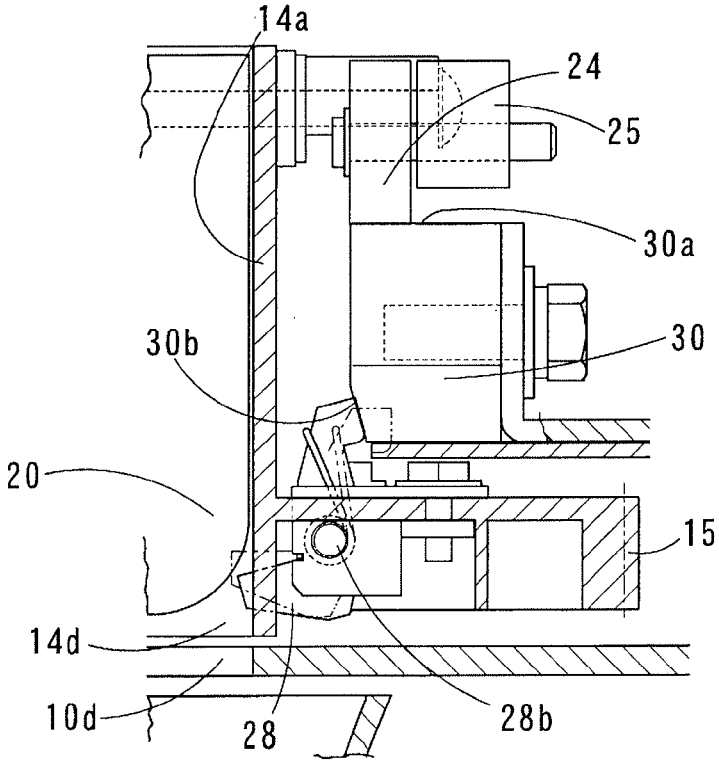

As shown in FIG. 13, the cam 30 is supported by a support leg 30*c* raised from the bottom plate of the housing 10. The cam is provided to correspond to the feeding hopper 3*a* to the tablet packaging section 3 (see FIG. 6) and has the same configuration as a cam indicated by reference numeral 82*d* in FIG. 13 of the above-mentioned Patent Document 1. As shown in FIGS. 15A to 15B, if the cam roller 24 rides on the cam surface (upper cam surface) 30*a* of the cam 30, then the cam roller 24 gradually ascends (moves upward) along the cam surface 30*a* and thus swings the swing plate 22 away from the fixed plate 21 against the spring 26 to greatly open the gap t in the lower end of the fixed plate 21 (to open the swing plate 22 and the fixed plate 21 (the bottom of the top-opened receiving portion)) such that the tablet T smoothly falls therethrough. Thereafter, the cam roller descends and, in concomitance with such descending movement, the swing plate 22 is swung by the spring 26 to abut the fixed plate 21 (FIG. 15A→FIG. 15B→FIG. 15A (however, the cam roller 24 is positioned in the opposite side on the cam surface 30*a*)).

Figure 12:
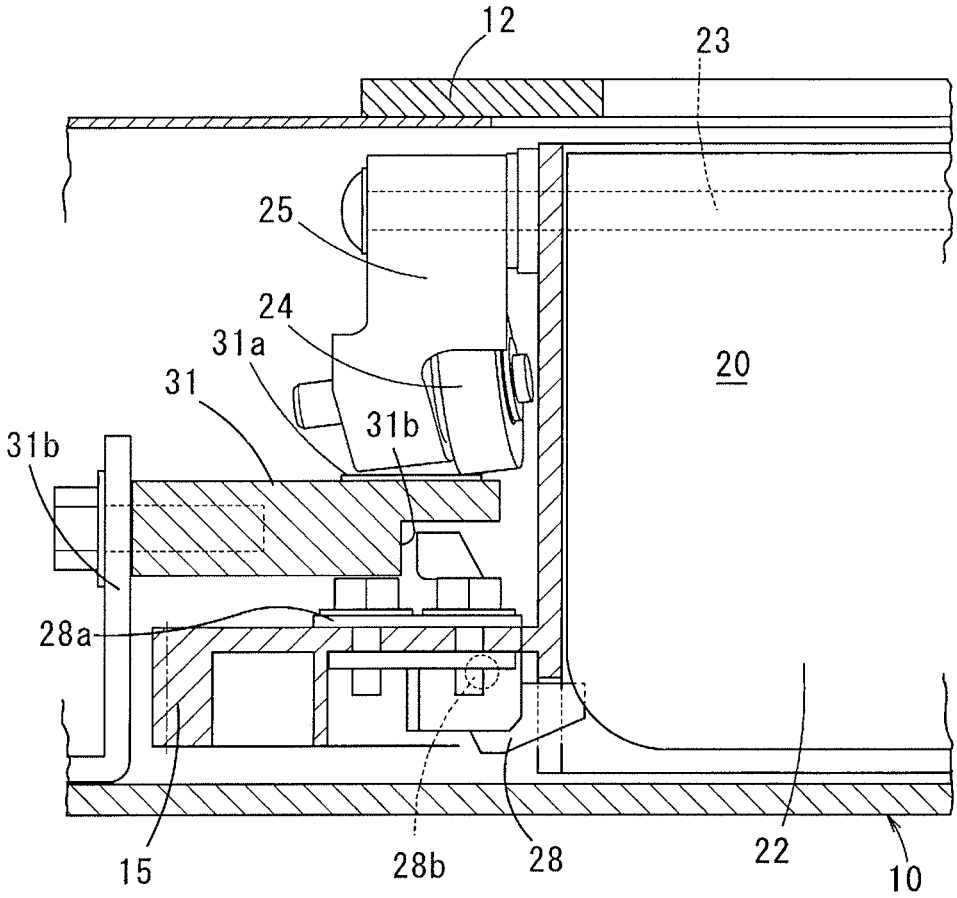
FIG. 12 is an enlarged cutaway view of a main part of the medicine preparation section.
Figure 16:
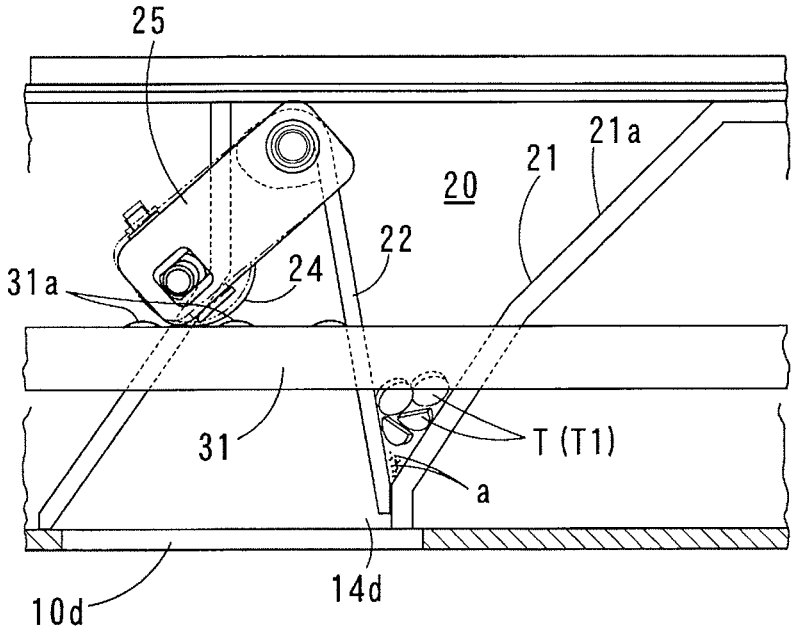
FIG. 16 illustrates an operation of removing a tablet-adhered powder in the embodiment.
Figure 16:
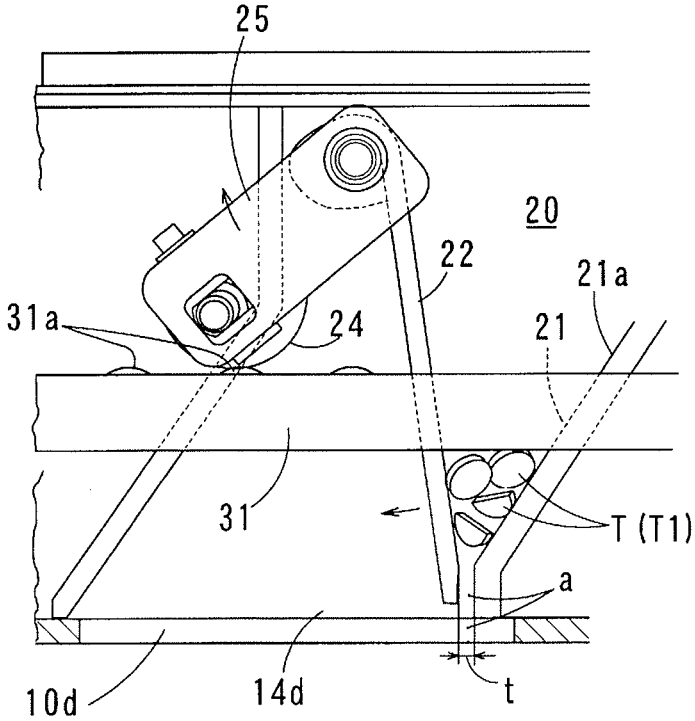
Figure 17:
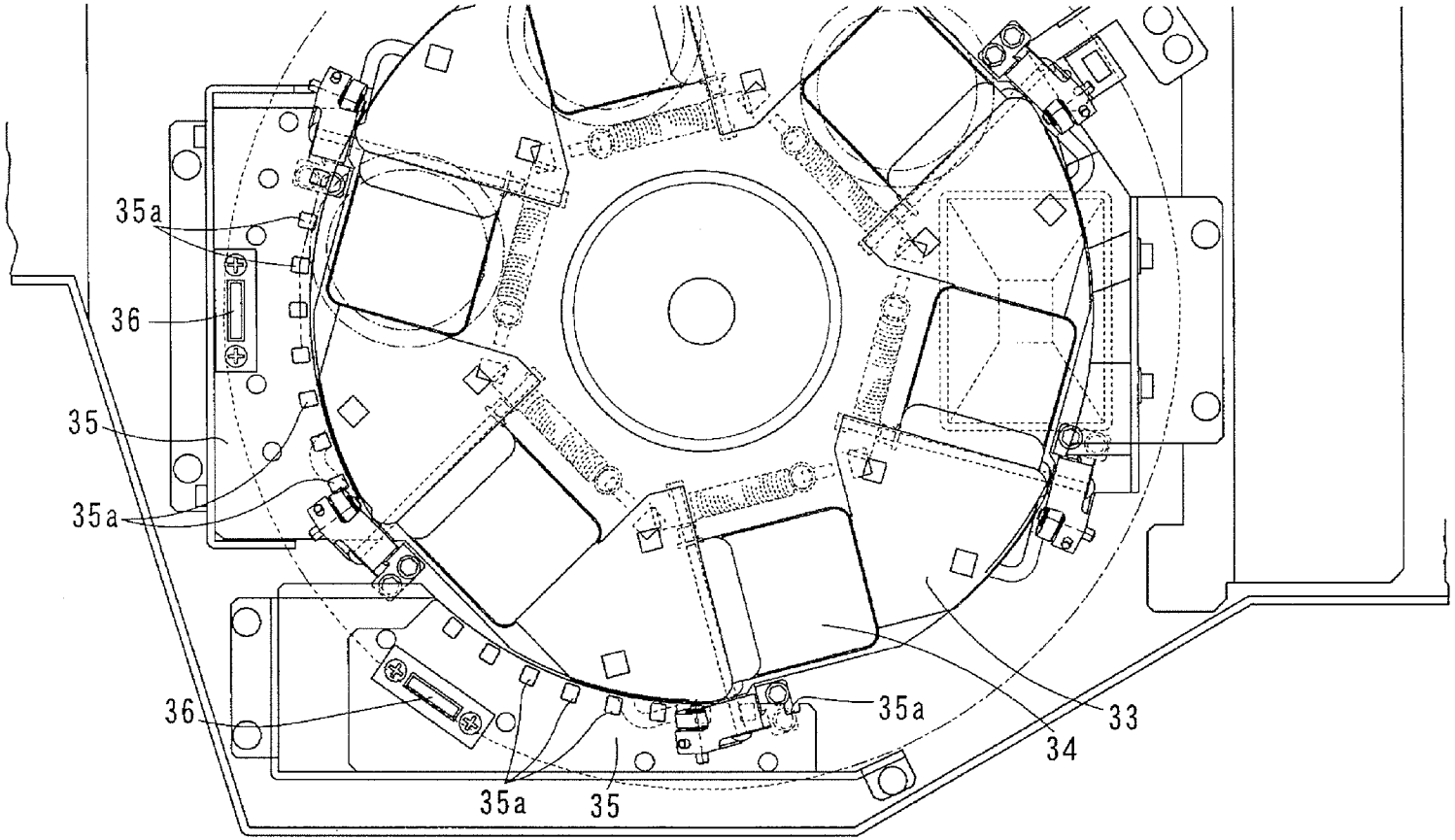
FIG. 17 is a top view showing a main part of a medicine preparation section according to another embodiment.
Figure 18:
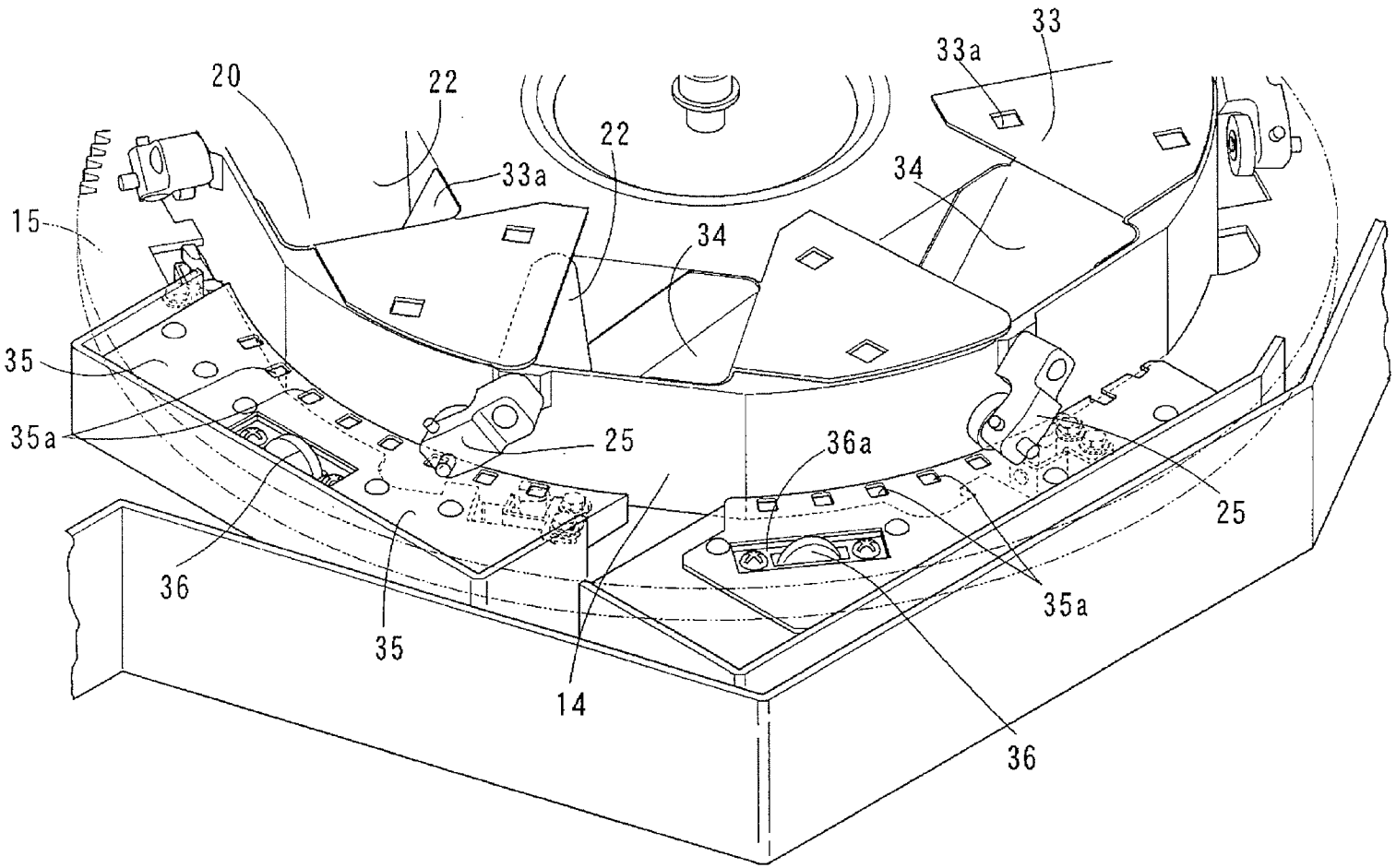
FIG. 18 is a perspective view showing a main part of the medicine preparation section.

As shown in FIGS. 11 and 12, the protrusions 31*a* are provided on an upper surface of an operating plate 31, which is provided to be raised from the bottom plate of the housing 10. For example, the protrusions are provided to correspond to about two intermittent rotations of the rotator 14 (about 150 degrees). As shown in FIG. 16, if the cam roller 24 rides on the protrusion 31*a* (as shown from FIG. 16(*a*) to FIG. 16(*b*)), the swing plate 22 is swung through the rotating shaft 23. In this case, since such swing movement is made within a range (the gap 1) regulated by the pawl 28, the lower end of the swing plate 22 and the lower end of the fixed plate 21 are only spaced from each other to the extent that the tablet T (the half tablet T1) cannot fall therethrough.

The swing movement of the swing plate 22 is done whenever the cam roller 24 rides on the protrusions 31*a*. Thus, the swing plate 22 vibrates as shown through FIG. 16(*a*)→FIG. 16(*b*)→FIG. 16(*a*) . . . . Due to such vibration, the tablet T between the swing plate 22 and the fixed plate 21 vibrates and bounces. Thus, the adhesion powder (including fragmented pieces) a touches with an edge of the groove-ridge portion 21*a* or is stripped due to difference in fall speed between the adhesion powder and the tablet T. Then, the adhesion powder generally moves along groove portions of the groove-ridge portion 21*a* and falls from the gap t in the lower ends of the both of the plates 21, 22, which is opened due to such vibration, toward the tablet discharging outlet 14*d* located below the gap. In this case, with the vibration as well as the groove-ridge portion 21*a*, the powder a, which is prone to adhere to the surfaces of the both of the plates 21, 22 due to static electricity, smoothly falls. Since the powder a falls from the groove portions, the lower ends of the both of the plates 21, 22 may be in contact with each other during the vibration. The powder a, which has fallen through the tablet discharging outlet 14*d* and the open hole 10*d*, falls onto a powder collecting tray 32 (see FIG. 5). The powder collecting tray 32 is appropriately drawn out to remove the collected powder a.

A cutout groove 31*b* is formed in an inner surface of the operating plate 31 and thus avoids interference with the pawl 28 when the swing plate 22 vibrates (see FIGS. 11 and 12). The powder collecting tray 32 is removably fitted to a guide 32*a* and is engaged by fitting between a leading edge thereof and a stopper metal part 32*b*.

The tablet introducing inlets 13*a*, 13*b*, 13*c* are formed at the intermittent rotation interval (60 degrees interval) from the hopper (introducing inlet) 3*a* for the tablet packaging section 3 along the rotation direction of the rotator 14. As one top-opened receiving portion 20 faces to each of the tablet discharging outlets 13*a*, 13*b*, 13*c* in sequence, the tablets T for one package are fed from the both of the tablet storing sections 1, 2 and the manual distribution unit 7.

Thus, after the tablets T have passed through each tablet introducing inlet 13*a*, 13*b*, 13*c* or the tablets T for one package are received in the top-opened receiving portion 20, the top-opened receiving portion reaches the plurality of protrusions 31*a* (powder removal portion) and thus removes the adhesion powder a, as shown in FIG. 16. Thereafter, the top-opened receiving portion is moved toward the hopper 3*a* for the tablet packaging section 3. If the top-opened receiving portion 20 is moved toward the hopper 3*a*, then, as shown from FIG. 15A to FIG. 15B, the upper end of the pawl 28 abuts the lateral surface 30*b* of the cam 30 and slides, thus releasing the engagement to the swing plate 22. Further, as shown in FIG. 15B, the cam roller 24 rides on the cam surface 30*a* and then the swing plate 22 is separated from the fixed plate 21 along with the rolling movement of the cam roller 24 on the cam surface 30*a*, thereby opening the bottom of the top-opened receiving portion 20. Due to such opening, the tablets T in the top-opened receiving portion 20 fall to the hopper 3*a* for the tablet packaging section through the tablet discharging outer 14*d* and the open hole 10*d* and then the tablets T for one package are packaged by the tablet packaging section 3.

If the cam roller 24 reaches a terminal end of the cam surface 30*a*, then the lower ends of both of the plates 21, 22 are closed. Thereafter, the upper end of the pawl 28 is not allowed to slide to the lateral surface 30*b* of the cam 30 and the lower end of the pawl 28 is brought into engagement with the back surface of the swing plate 22 due to the spring 29, thereby regulating the swing movement of the swing plate 22. By repeating the above-described operations, the followings are performed in sequence: inputting the tablets T for one package to the top-opened receiving portions 20; removing the adhesion powder by means of vibration; and feeding the tablets T without the adhesion powder to the tablet packaging section 3. Further, the packaging operations for one package according to a prescription are performed in sequence. In the figures, reference numeral 33 indicates a cover closing a portion of the top of the top-opened receiving portion 20.

Further, the groove portions of the groove-ridge portion 21*a* may comprise a slit located at the bottom opening. In this case, since the powder a falls through the slit, an open hole for the fall of the powder is formed in the bottom plate of the rotator 14 and a tray for receiving the powder a is detachably provided at the bottom of the housing 10. Further, since the powder a fall from such a groove portion, the lower ends of the both of the plates 21, 22 may be in contact with each other during the vibration.

FIGS. 17 to 20 show another embodiment. In this embodiment, a trough-shaped metal part 34 is provided on the surface of the fixed plate 21 of the top-opened receiving portion 20. Further, a vibration-applying piece 35, which makes a prominence and depression on which the cam roller 24 rolls to thereby move vertically, and a roller 36 are provided in the operating plate 31.

The metal part 34 is integrated with the cover 33. The metal part 34 is surface-treated by a surface treatment wherein a steel, stainless or copper alloy plate is eutectic with nickel and fluorine resin and then is heat-treated, thus having a slip property on its inner surface. The metal part 34 is secured to the rotator 14 in such a manner that a cut-raised claw 33*a* of the cover 33 is inserted and fitted to a hole in the upper surface of the rotator 14. If the metal part 34 has the slip property as described above, the tablets T, T1 or the powder stripped therefrom smoothly fall without any adherence. The vibration generates the static electricity and the static electricity stays. Such smooth fall prevents the static electricity from hindering the fall of the tablets and the powder. Instead of the metal part 34, the fixed plate 21 may have the slip property on its surface by directly coating (applying) the surface of the fixed plate with a slippage agent such as fluorine resin. The application of the slip property using coating may be done on the swing plate 22. It is a matter of course that the above-described slippage treatment can be employed to the embodiment shown in FIG. 4, etc.

Figure 20:
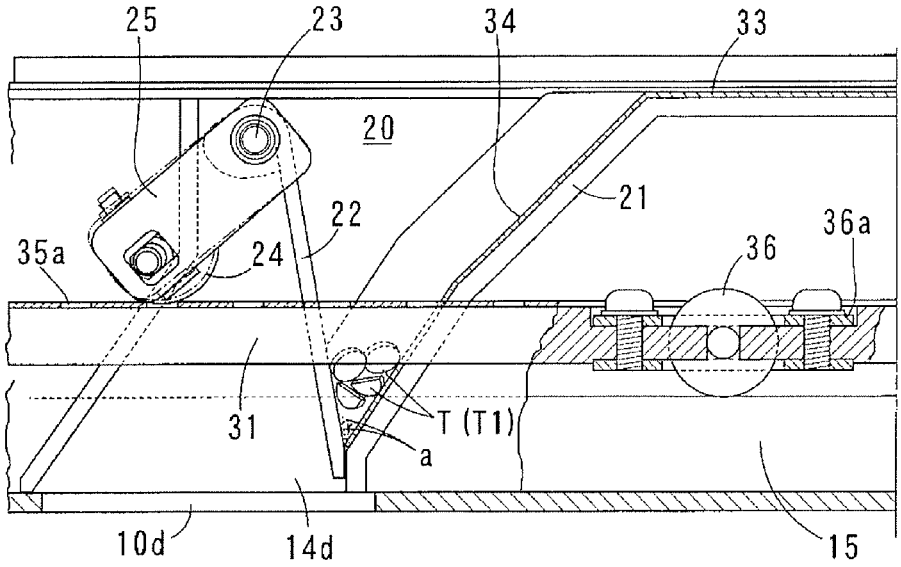
FIG. 20 illustrates an operation of removing a tablet-adhered powder in the embodiment.
Figure 20:
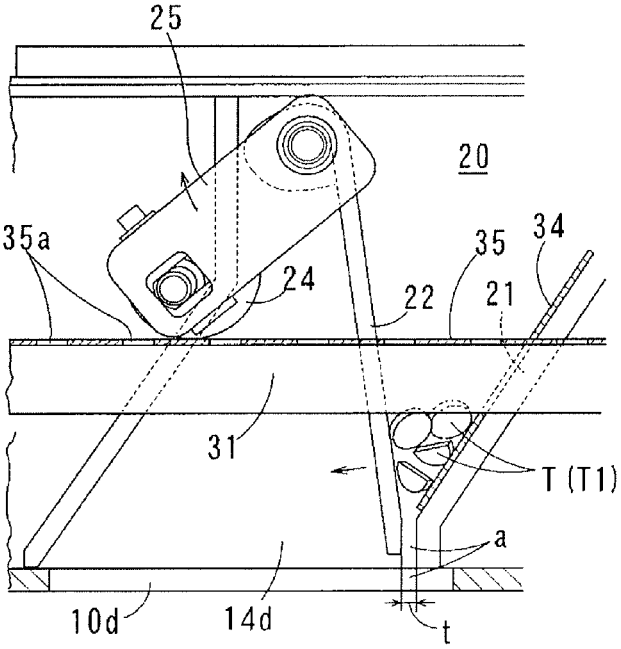

The vibration-applying piece 35 is screw-coupled to the operating plate 31. Cutout portions (apertures) 35*a* are formed in the vibration-applying piece along a rolling movement trajectory of the cam roller 24 and thus the trajectory path becomes the prominence and depression. Thus, if the cam roller 24 rolls on such a prominence and depression path, as shown in FIG. 20, then the cam roller 24 vertically moves along such prominence and depression. Further, in concomitance with such a vertical movement, the swing plate 22 swings and vibrates through the rotating shaft 23 as shown in FIG. 20(*a*)→FIG. 20(*b*)→FIG. 20(*a*) . . . . With such vibration, the tablets T between the swing plate 22 and the fixed plate 21 (the metal part 34) vibrate and bounce. Further, the adhesion powder (including fragmented pieces) a of the tablet comes in touch with the metal part 34 with the slip property surface or is stripped due to difference in fall speed between the powder and the tablets T. Then, the powder falls from the gap t in the lower ends of the both of the plates 21 (34), 22, which is opened due to the vibration, to the tablet discharging outlet 14*d* located below the gap. The vibration-applying piece 35 is preferably made from a metallic material such as stainless in terms of durability, however other material such as plastic may be employed.

Further, the roller 36 is through the operating plate 31. Its attachment frame 36*a* is screw-coupled to the operating plate and its lower projecting portion is in pressure contact with the upper peripheral surface of the large gear 15 of the rotator 14 (see FIGS. 19 and 20(*a*)). Such pressure contact restrains the vibration of the rotator 14, which is caused by the vibration resulted from the rolling movement of the cam roller 24 on the prominence and depression path. That is, it is restrained that the rotator 14 rattles or ripples due to the application of the vibration to the swing plate 22, thus preventing the bottom of the rotator 14 from touching with another member. It is a matter of course that the roller 36 can be employed to the embodiment shown in FIG. 4, etc.

Figure 19:
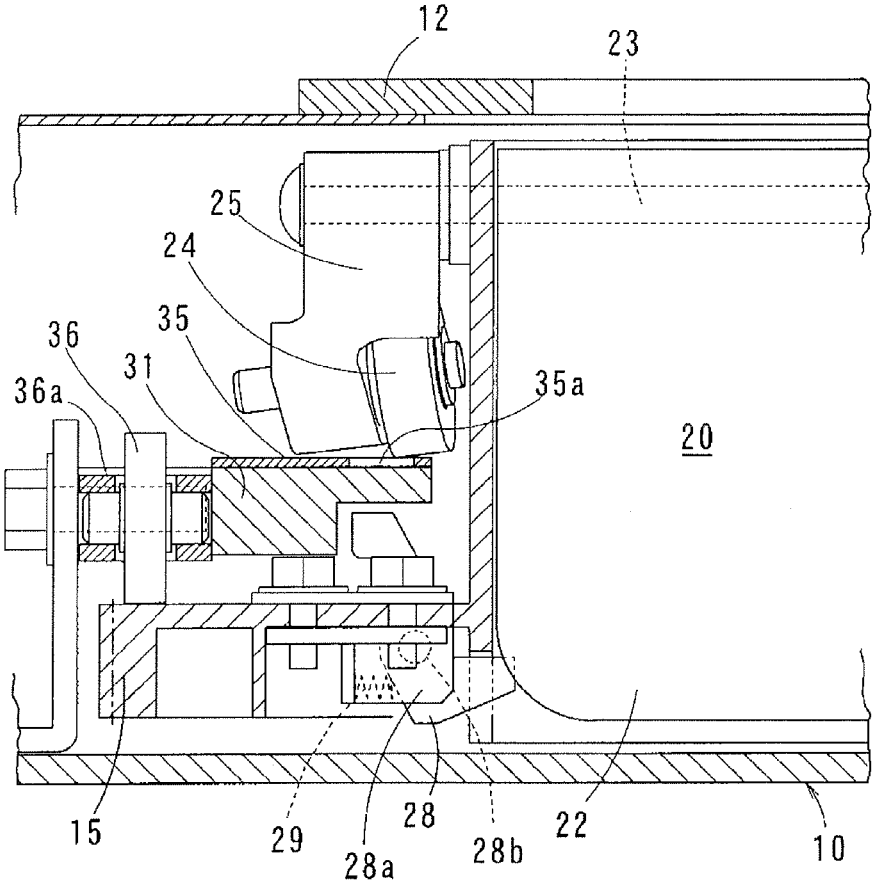
FIG. 19 is an enlarged cutaway view showing a main part of the medicine preparation section.

Further, in this embodiment, the spring 29, which biases the pawl 28 such that the lower end of the pawl engages the back surface of the swing plate 22 at normal times, is provided between the support metal part 28*a* and the lower back surface of the pawl 28 (see FIG. 19), thus preventing the abrasion powder of the spring 29 and the shaft 29 from being made due to friction between the torsion spring 29 and the shaft 28*b* shown in FIG. 8. The spring 29 shown in FIG. 19 is a coil spring and is provided in the support metal part 28*a* by welding one end of the spring to the support metal part 28*a*. It is a matter of course to employ the configuration of the coil spring 29 to the configuration shown in FIG. 8.

In each of the foregoing embodiments, similar to the swing plate 22, the fixed plate 21 may be configured to swing and vibrate. Further, the protrusions 31*a* or the vibration-applying piece 35 (cutout portions 35*a*) may be provided in another position, e.g., between the introducing inlet 13*a* and the introducing inlet 13*b*, or between the introducing inlet 13*b* and the introducing inlet 13*c*. However, as described in the foregoing embodiments, it is preferred that the position is next to the introducing inlet 13*c* after the top-opened receiving portion 20 receives the tablets T for one package. However, in case the cut and divided tablets fall, for example, in case the tablet dividing feeder is in the main tablet storing section 1, the position may be next to the introducing inlet 13*a*. The protrusions 31*a* may be formed by embossing a portion of the vibration-applying plate 35 by means of a punch.

DESCRIPTION OF REFERENCE NUMERALS

T . . . Tablet
T1 . . . Half tablet
1 . . . Main tablet storing section
2 . . . Sub tablet storing section
3 . . . Tablet packaging section
3*a* . . . Feeding hopper to tablet packaging section
4*a*, 4*b*, 4*c* . . . Tablet collection hopper
8 . . . Tablet preparation section
10 . . . Housing of tablet preparation section
12 . . . Ceiling plate of housing
20 . . . Top-opened receiving portion
21 . . . Fixed plate
21*a* . . . Groove-ridge portion
22 . . . Swing plate
23 . . . Rotating shaft of swing plate
24 . . . Cam roller
26 . . . Spring for biasing swing plate
30 . . . Cam for opening swing plate
31*a* . . . Prominence and depression forming protrusions for applying vibration to swing plate
34 . . . Metal part with slip property
35 . . . Vibration-applying piece
35*a* . . . Prominence and depression forming cutaway portions for applying vibration to swing plate
36 . . . Roller for restricting vibration of rotator

What is claimed is:

1. A powder removal device of a medicine dispenser for feeding a tablet dispensed from a tablet storing section having at least one tablet feeder to a tablet packaging section for packaging the tablet, the powder removal device interposed between the tablet storing section and the tablet packaging section to remove a tablet-adhered powder, the powder removal device comprising:

a top-opened receiving portion configured to receive a tablet for a package from the tablet storing section, the top-opened receiving portion being provided between the tablet storing section and the tablet packaging section;

a vibrating mechanism configured to vibrate the top-opened receiving portion; and an opening and closing mechanism configured to open and close a bottom of the top-opened receiving portion, wherein the bottom of the top-opened receiving portion has a gap, through which the tablet does not fall, wherein the opening and closing mechanism is configured to widen the gap to an extent of permitting the tablet to fall, such that the tablet falls through the gap to the tablet packaging section, wherein the opening and closing mechanism is further configured to widen the gap to an extent less than the extent of permitting the tablet to fall, such that the tablet-adhered powder removed from the tablet due to a vibration caused by the vibrating mechanism falls through the gap, and wherein the opening and closing mechanism is further configured to widen and completely close the gap during the vibration caused by the vibrating mechanism.

2. The powder removal device of claim 1, wherein the top-opened receiving portion includes a pair of opposing side wall plates disposed in a tapered shape, wherein lower ends of the side wall plates have therebetween the gap through which the tablet does not fall, and wherein the opening and closing mechanism is configured to move at least one of the side wall plates to an extent that the gap between the lower ends of the side wall plates permits the tablet to fall.

3. The powder removal device of claim 2, wherein a plurality of the top-opened receiving portions are provided in a rotator at equal interval around a rotation center of the rotator, wherein a first introducing inlet to the tablet packaging section opens in a portion of a rotation trajectory of each of the top-opened receiving portions, and wherein a second introducing inlet, through which the tablet is to be introduced from the tablet storing section, is spaced along a rotation direction of the rotator from the first introducing inlet.

4. The powder removal device of claim 3, wherein a roller is provided in a fixed member opposed to the rotator, the roller being in pressure contact with the rotator to restrain the vibration caused by the vibrating mechanism.

5. The powder removal device of claim 3, wherein the at least one of the opposing side wall plates of the top-opened receiving portion is swingably supported at an upper end thereof and is biased by a spring in a direction of contacting the other side wall plate, wherein the swingable side wall plate is contacted with and separated from a prominence and depression around the rotator, and wherein the swingable side wall plate is swung while maintaining the gap, through which the tablet does not fall, to apply the vibration to the top-opened receiving portion.

6. The powder removal device of claim 5, wherein a cam roller is provided in a swing shaft of the swingable side wall plate via an arm extending in a diametrical direction of the swing shaft, and wherein the cam roller is contacted with and separated from the prominence and depression, to apply the vibration to the top-opened receiving portion.

7. The powder removal device of claim 6, wherein the swingable side wall plate is swung to open and close the bottom of the top-opened receiving portion, wherein a stopper is provided in the rotator to engage the swingable side wall plate such that the swingable side wall plate maintains the gap through which the tablet does not fall, and wherein the stopper is configured to release an engagement to the swingable side wall plate when the gap between the lower ends of the side wall plates is widened by the opening and closing mechanism to the extent of permitting the tablet to fall.

8. The powder removal device of claim 6, wherein the cam roller is configured to roll on a cam surface of a cam provided around the rotator to swing the side wall plates to widen the gap between the lower ends of the side wall plates to the extent of permitting the tablet to fall.

9. The powder removal device of claim 1, wherein a powder collecting tray is provided below the gap of the bottom of the top-opened receiving portion for receiving the tablet-adhered powder of the tablet through the gap.

10. The powder removal device of claim 1, wherein the at least one tablet feeder is configured to cut and divide the tablet.

11. A powder removal device of a medicine dispenser for feeding a tablet dispensed from a tablet storing section having at least one tablet feeder to a tablet packaging section for packaging the tablet, the powder removal device interposed between the tablet storing section and the tablet packaging section to remove a tablet-adhered powder, the powder removal device comprising:

a top-opened receiving portion configured to receive a tablet for a package from the tablet storing section, the top-opened receiving portion being provided between the tablet storing section and the tablet packaging section;

a vibrating mechanism configured to vibrate the top-opened receiving portion; and an opening and closing mechanism configured to open and close a bottom of the top-opened receiving portion, wherein the bottom of the top-opened receiving portion has a gap, through which the tablet does not fall, wherein the opening and closing mechanism is configured to widen the gap to an extent of permitting the tablet to fall, wherein the top-opened receiving portion includes a pair of opposing side wall plates disposed in a tapered shape, wherein lower ends of the side wall plates have therebetween the gap through which the tablet does not fall, wherein the opening and closing mechanism is configured to move at least one of the side wall plates to an extent that the gap between the lower ends of the side wall plates permits the tablet to fall, wherein a plurality of the top-opened receiving portions are provided in a rotator at equal interval around a rotation center of the rotator, wherein the at least one of the opposing side wall plates of the top-opened receiving portion is swingably supported at an upper end thereof and is biased by a spring in a direction of contacting the other side wall plate, wherein the swingable side wall plate is contacted with and separated from a prominence and depression around the rotator, and wherein the swingable side wall plate is swung while maintaining the gap, through which the tablet does not fall, to apply a vibration to the top-opened receiving portion.

12. The powder removal device of claim 11, wherein a cam roller is provided in a swing shaft of the swingable side wall plate via an arm extending in a diametrical direction of the swing shaft, and wherein the cam roller is contacted with and separated from the prominence and depression, to apply the vibration to the top-opened receiving portion.

13. The powder removal device of claim 12, wherein the swingable side wall plate is swung to open and close the bottom of the top-opened receiving portion, wherein a stopper is provided in the rotator to engage the swingable side wall plate such that the swingable side wall plate maintains the gap through which the tablet does not fall, and wherein the stopper is configured to release an engagement to the swingable side wall plate when the gap between the lower ends of the side wall plates is widened by the opening and closing mechanism to the extent of permitting the tablet to fall.

14. The powder removal device of claim 12, wherein the cam roller is configured to roll on a cam surface of a cam provided around the rotator to swing the side wall plates to widen the gap between the lower ends of the side wall plates to the extent of permitting the tablet to fall.

15. The powder removal device of claim 11, wherein a first introducing inlet to the tablet packaging section opens in a portion of a rotation trajectory of each of the top-opened receiving portions, and wherein a second introducing inlet, through which the tablet is to be introduced from the tablet storing section, is spaced along a rotation direction of the rotator from the first introducing inlet.

16. The powder removal device of claim 11, wherein a roller is provided in a fixed member opposed to the rotator, the roller being in pressure contact with the rotator to restrain a vibration caused by the vibrating mechanism.

17. A powder removal device of a medicine dispenser for feeding a tablet dispensed from a tablet storing section having at least one tablet feeder to a tablet packaging section for packaging the tablet, the powder removal device interposed between the tablet storing section and the tablet packaging section to remove a tablet-adhered powder, the powder removal device comprising:

a top-opened receiving portion configured to receive a tablet for a package from the tablet storing section, the top-opened receiving portion being provided between the tablet storing section and the tablet packaging section;

a vibrating mechanism configured to vibrate the top-opened receiving portion; and an opening and closing mechanism configured to open and close a bottom of the top-opened receiving portion, wherein the bottom of the top-opened receiving portion has a gap, through which the tablet does not fall, the opening and closing mechanism is configured to widen the gap to an extent of permitting the tablet to fall, such that the tablet falls through the gap, and an extent less than the extent of permitting the tablet to fall, such that the tablet-adhered powder removed from the tablet due to a vibration caused by the vibrating mechanism falls through the gap, the top-opened receiving portion includes a pair of opposing side wall plates disposed in a tapered shape, lower ends of the side wall plates have therebetween the gap through which the tablet does not fall, the powder removal device further comprises a rotator, and the opening and closing mechanism comprises a cam roller configured to roll on a cam surface of a cam provided around the rotator to swing the side wall plates to widen the gap between the lower ends of the side wall plates to the extent of permitting the tablet to fall.

18. The powder removal device of claim 17, wherein the at least one of the opposing side wall plates of the top-opened receiving portion is swingably supported at an upper end thereof and is biased toward the other side wall plate, and the cam roller is contacted with and separated from a prominence and depression around the rotator to swing the swingable side wall plate, while maintaining the gap at an extent insufficient for the tablet to fall through, to apply the vibration to the top-opened receiving portion.

19. The powder removal device of claim 18, wherein the cam roller is provided in a swing shaft of the swingable side wall plate via an arm extending in a diametrical direction of the swing shaft.

* * * * *